US010845125B2

(12) United States Patent
Wilson et al.

(10) Patent No.: US 10,845,125 B2
(45) Date of Patent: Nov. 24, 2020

(54) HEAT EXCHANGER

(71) Applicant: Daikin Applied Americas Inc., Minneapolis, MN (US)

(72) Inventors: Michael J. Wilson, Plymouth, MN (US); Robert Page, Minneapolis, MN (US); Louis A. Moreaux, Minneapolis, MN (US); Jeffrey Stamp, Minneapolis, MN (US); Satoshi Inoue, Maple Grove, MN (US); Shannon Cobb, Minneapolis, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 92 days.

(21) Appl. No.: 16/225,639

(22) Filed: Dec. 19, 2018

(65) Prior Publication Data

US 2020/0200479 A1 Jun. 25, 2020

(51) Int. Cl.
*F28D 1/053* (2006.01)
*F25B 39/02* (2006.01)
(Continued)

(52) U.S. Cl.
CPC ..... *F28D 1/05391* (2013.01); *F25B 39/022* (2013.01); *F28F 9/028* (2013.01);
(Continued)

(58) Field of Classification Search
CPC ..... F28D 1/05391; F28D 2021/0071; F28F 9/028; F25B 39/022; F25B 39/04; F25B 2400/072
(Continued)

(56) References Cited

U.S. PATENT DOCUMENTS 2,012,183 A 8/1935 Carrier et al.
6,293,112 B1 9/2001 Moeykens et al.
(Continued)

FOREIGN PATENT DOCUMENTS

WO 2011/011421 A2 1/2011

OTHER PUBLICATIONS

The International Search Report and the Written Opinion for the corresponding international application No. PCT/US2019/066752, dated Apr. 2, 2020.

*Primary Examiner* — Henry T Crenshaw
(74) *Attorney, Agent, or Firm* — Global IP Counselors, LLP

(57) ABSTRACT

A heat exchanger includes a shell, refrigerant distributor, tube bundle, and first upper baffle. The shell has a refrigerant inlet through which at least refrigerant with liquid refrigerant flows and a shell refrigerant vapor outlet. A longitudinal center axis of the shell extends substantially parallel to a horizontal plane. The refrigerant distributor fluidly communicates with the refrigerant inlet and is disposed within the shell. The refrigerant distributor has at least one liquid refrigerant distribution opening that distributes liquid refrigerant. The tube bundle is disposed inside of the shell below the refrigerant distributor so that the liquid refrigerant discharged from the refrigerant distributor is supplied to the tube bundle. The first upper baffle is vertically disposed at a top of the tube bundle. The first upper baffle extends laterally outwardly from the tube bundle toward a first lateral side of the shell.

20 Claims, 10 Drawing Sheets

(51) Int. Cl.
*F28F 9/02* (2006.01)
*F25B 39/04* (2006.01)
*F28D 21/00* (2006.01)

(52) U.S. Cl.
CPC ..... *F25B 39/04* (2013.01); *F25B 2400/072* (2013.01); *F28D 2021/0071* (2013.01)

(58) Field of Classification Search
USPC ..... 165/164
See application file for complete search history.

(56) References Cited

U.S. PATENT DOCUMENTS

| | | | | |
|---|---|---|---|---|
| 6,868,695 | B1 * | 3/2005 | Dingel | F25B 39/028 165/115 |
| 9,541,314 | B2 | 1/2017 | Numata et al. | |
| 9,810,458 | B2 | 11/2017 | Hattori et al. | |
| 2014/0223936 | A1 | 8/2014 | Hartfield et al. | |
| 2017/0241681 | A1 * | 8/2017 | Su | F28D 5/02 |
| 2018/0172327 | A1 * | 6/2018 | Christians | F28F 9/0273 |

* cited by examiner

HEAT EXCHANGER

BACKGROUND OF THE INVENTION

Field of the Invention

This invention generally relates to a heat exchanger adapted to be used in a vapor compression system. More specifically, this invention relates to a heat exchanger including at least one baffle arranged to restrict vapor flow, reduce local vapor velocity, isolate liquid leakage and/or trap liquid.

Background Information

Vapor compression refrigeration has been the most commonly used method for air-conditioning of large buildings or the like. Conventional vapor compression refrigeration systems are typically provided with an evaporator, which is a heat exchanger that allows the refrigerant to evaporate from liquid to vapor while absorbing heat from liquid to be cooled passing through the evaporator. One type of evaporator includes a tube bundle having a plurality of horizontally extending heat transfer tubes through which the liquid to be cooled is circulated, and the tube bundle is housed inside a cylindrical shell. There are several known methods for evaporating the refrigerant in this type of evaporator. In a flooded evaporator, the shell is filled with liquid refrigerant and the heat transfer tubes are immersed in a pool of the liquid refrigerant so that the liquid refrigerant boils and/or evaporates as vapor. In a falling film evaporator, liquid refrigerant is deposited onto exterior surfaces of the heat transfer tubes from above so that a layer or a thin film of the liquid refrigerant is formed along the exterior surfaces of the heat transfer tubes. Heat from walls of the heat transfer tubes is transferred via convection and/or conduction through the liquid film to the vapor-liquid interface where part of the liquid refrigerant evaporates, and thus, heat is removed from the water flowing inside of the heat transfer tubes. The liquid refrigerant that does not evaporate falls vertically from the heat transfer tube at an upper position toward the heat transfer tube at a lower position by force of gravity. There is also a hybrid falling film evaporator, in which the liquid refrigerant is deposited on the exterior surfaces of some of the heat transfer tubes in the tube bundle and the other heat transfer tubes in the tube bundle are immersed in the liquid refrigerant that has been collected at the bottom portion of the shell.

Although the flooded evaporators exhibit high heat transfer performance, the flooded evaporators require a considerable amount of refrigerant because the heat transfer tubes are immersed in a pool of the liquid refrigerant. With the recent development of new and high-cost refrigerant having a much lower global warming potential (such as R1234ze or R1234yf), it is desirable to reduce the refrigerant charge in the evaporator. The main advantage of the falling film evaporators is that the refrigerant charge can be reduced while ensuring good heat transfer performance. Therefore, the falling film evaporators have a significant potential to replace the flooded evaporators in large refrigeration systems. Regardless of the type of evaporator, e.g., flooded, falling film, or hybrid, refrigerant entering the evaporator is distributed to the tube bundle where evaporation of refrigerant occurs due to heating from liquid in the tube bundle. As refrigerant evaporates, refrigerant vapor is present.

SUMMARY OF THE INVENTION

It has been discovered that the vapor velocity can become quite high in some evaporators, which increases the likelihood of liquid carry over where liquid droplets enter the inlet of the compressor. This can cause a reduction in chiller efficiency and potentially increase the possibility of erosion of the impeller blade. If low pressure refrigerants such as R1233zd are used, these issues can occur more readily, although these issues can be present regardless of the refrigerant.

Therefore, one object of the present invention is to provide an evaporator that reduces or eliminates spray droplets being sent to the compressor.

One technology used for reducing or eliminating spray droplets is a mist eliminator. Though a mist eliminator can be effective, a mist eliminator may be relatively costly and bulky, taking up much room in the evaporator. In addition, a mist eliminator can cause high pressure drop, which may adversely affect system coefficient of performance (COP). Space requirements can lead to increased shell size and chiller size.

Therefore, another object of the present invention is to provide an evaporator with one or more baffles to redistribute the vapor flow inside of the evaporator. Such baffle(s) can force the flow to equalize and reduce local velocity. Lower velocity allows liquid droplets to settle out of the flow. In addition, such baffle(s) is/are less expensive and take up less space than a mist eliminator.

Another object is to provide a baffle used to even out the vapor flow near the top of the falling film bank by restricting upward vapor flow.

Another object is to provide a baffle used to reduce local vapor velocity between first and second tube passes and remove any liquid droplets by momentum.

Another object is to provide a baffle used to isolate any liquid leakage from the distributor from the bulk vapor flow. Such a baffle is also used to trap and drain any liquid from high speed vapor between the top row of falling film bank and bottom of the distributor.

Yet another object is to provide a baffle used to trap any liquid being dragged up the sides of the shell and direct it onto tubes for evaporation.

On or more of the foregoing objects may be obtained by a heat exchanger in accordance with any one or more of the following aspects. However, the aspects and combinations of aspects mentioned below are merely examples of possible aspects and combinations of aspect disclosed herein that may achieve one or more of the above objects.

A heat exchanger according to a first aspect of the present invention is adapted to be used in a vapor compression system. The heat exchanger includes a shell, refrigerant distributor, tube bundle, and first upper baffle. The shell has a refrigerant inlet through which at least refrigerant with liquid refrigerant flows and a shell refrigerant vapor outlet. A longitudinal center axis of the shell extends substantially parallel to a horizontal plane. The refrigerant distributor fluidly communicates with the refrigerant inlet and disposed within the shell. The refrigerant distributor has at least one liquid refrigerant distribution opening that distributes liquid refrigerant. The tube bundle is disposed inside of the shell below the refrigerant distributor so that the liquid refrigerant discharged from the refrigerant distributor is supplied to the tube bundle. The first upper baffle is vertically disposed at a top of the tube bundle. The first upper baffle extends laterally outwardly from the tube bundle toward a first lateral side of the shell.

In a second aspect, according to the heat exchanger of the first aspect, the first upper baffle includes a first upper non-permeable portion laterally disposed adjacent to the tube bundle.

In a third aspect, according to the heat exchanger of the second aspect, the first upper baffle includes a first upper permeable portion laterally disposed outwardly of the first upper non-permeable portion, and the first upper permeable portion is adjacent to the first lateral side of the shell.

In a fourth aspect, according to the heat exchanger of the third aspect, the first upper permeable portion has a lateral width less than 50% of an overall lateral width of the first upper baffle.

In a fifth aspect, according to the heat exchanger of the third or fourth aspects, the first upper non-permeable portion has a lateral width larger than the lateral width of the first upper permeable portion.

In a sixth aspect, according to the heat exchanger of any of the third to fifth aspects, the first upper baffle is formed of a non-permeable material with holes formed therein to form the first upper permeable portion.

In a seventh aspect, according to the heat exchanger of any of the first to sixth aspects, the first upper baffle is vertically disposed at a bottom of the refrigerant distributor.

In an eighth aspect, according to the heat exchanger of the seventh aspect, the first upper baffle is attached to a bottom of the refrigerant distributor.

In a ninth aspect, according to the heat exchanger of the seventh or eighth aspects, the first upper baffle is vertically supported by at least one tube support that supports the tube bundle.

In a tenth aspect, according to the heat exchanger of any of the first to ninth aspects, the first upper baffle is vertically disposed 40% to 70% of an overall height of the shell above a bottom edge of the shell.

In an eleventh aspect, according to the heat exchanger of any of the first to tenth aspects, a second upper baffle is vertically disposed at the top of the tube bundle. The second upper baffle extends laterally outwardly from the tube bundle toward a second lateral side of the shell.

In a twelfth aspect, according to the heat exchanger of any of the first to eleventh aspects, a first lower baffle is vertically disposed below the first upper baffle. The first lower baffle extends laterally inwardly from the first lateral side of the shell.

In a thirteenth aspect, according to the heat exchanger of the twelfth aspect, the plurality of heat transfer tubes are grouped to form an upper group and a lower group with a pass lane disposed between the upper group and the lower group, and the first lower baffle is vertically disposed above the pass lane.

In a fourteenth aspect, according to the heat exchanger of the twelfth or thirteenth aspects, the first lower baffle is vertically disposed 20% to 40% of an overall height of the shell above a bottom edge of the shell.

In a fifteenth aspect, according to the heat exchanger of any of the twelfth to fourteenth aspects, the first lower baffle extends laterally inwardly from the first lateral side of the shell by a distance not more than 20% of a width of the shell measured at the first lower baffle and perpendicularly relative to the longitudinal center axis.

In a sixteenth aspect, according to the heat exchanger of any of the twelfth to fifteenth aspects, the first lower baffle includes a first lower permeable portion.

In a seventeenth aspect, according to the heat exchanger of the sixteenth aspect, the first lower baffle is formed of a non-permeable material with holes formed therein to form the first lower permeable portion.

In an eighteenth aspect, according to the heat exchanger of the sixteenth or seventeenth aspects, the first lower permeable portion forms a majority of the first lower baffle.

In a nineteenth aspect, according to the heat exchanger of any of the twelfth to eighteenth aspects, the first lower baffle extends laterally inwardly toward the tube bundle to a free end of the first lower baffle that is laterally spaced from the tube bundle.

In a twentieth aspect, according to the heat exchanger of any of the twelfth to nineteenth aspects, a second upper baffle is vertically disposed at the top of the tube bundle, and a second lower baffle vertically disposed below the second upper baffle. The second upper baffle extends laterally outwardly from the tube bundle toward a second lateral side of the shell. The second lower baffle extends laterally inwardly from the second lateral side of the shell.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENT(S)

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
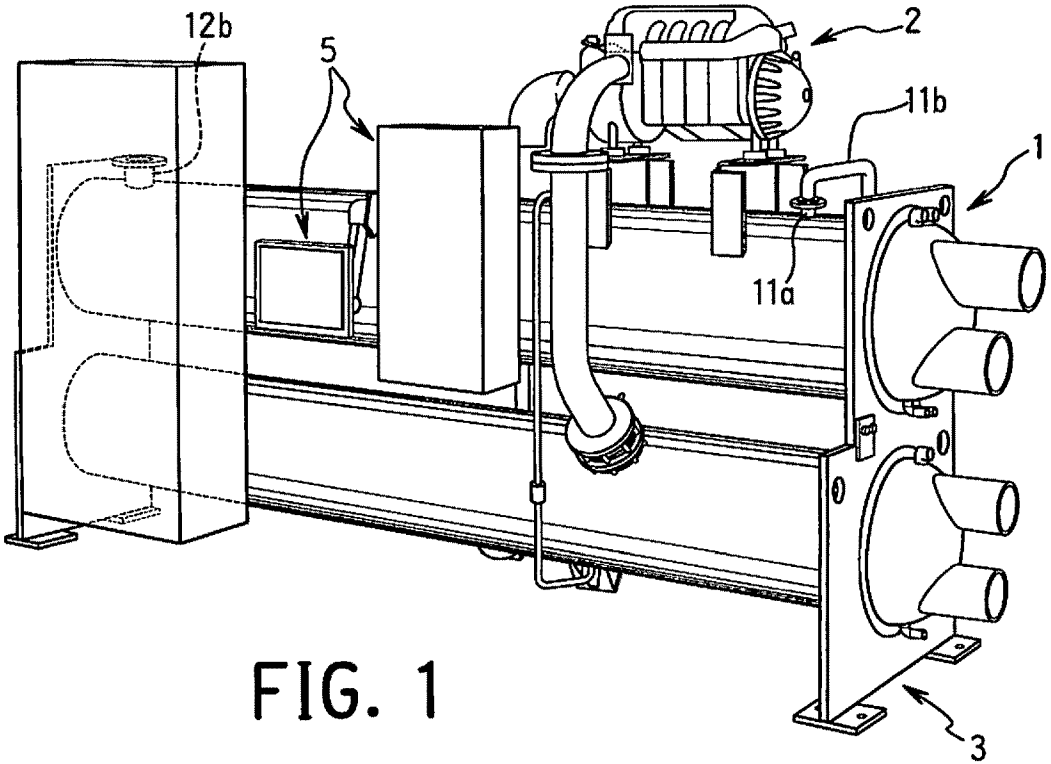
FIG. 1 is a simplified, overall perspective view of a vapor compression system including a heat exchanger according to a first embodiment of the present invention.
Figure 2:
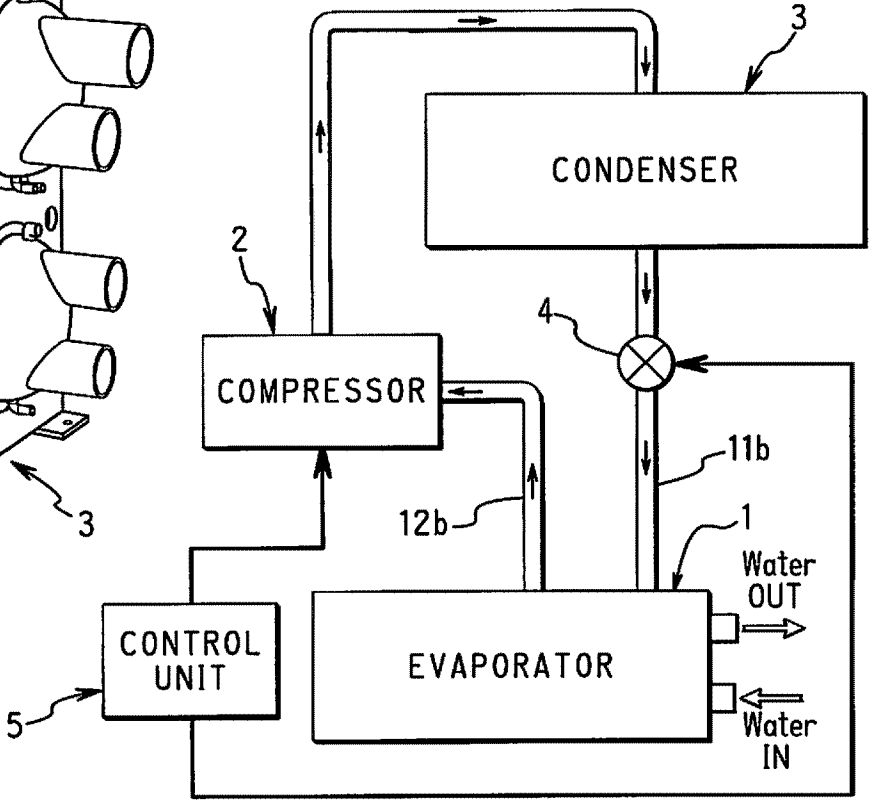
FIG. 2 is a block diagram illustrating a refrigeration circuit of the vapor compression system including the heat exchanger according to the first embodiment of the present invention.

Referring initially to FIGS. 1 and 2, a vapor compression system including a heat exchanger 1 according to a first embodiment will be explained. As seen in FIG. 1, the vapor compression system according to the first embodiment is a chiller that may be used in a heating, ventilation and air conditioning (HVAC) system for air-conditioning of large buildings and the like. The vapor compression system of the first embodiment is configured and arranged to remove heat from liquid to be cooled (e.g., water, ethylene glycol, calcium chloride brine, etc.) via a vapor-compression refrigeration cycle.

Figure 4:
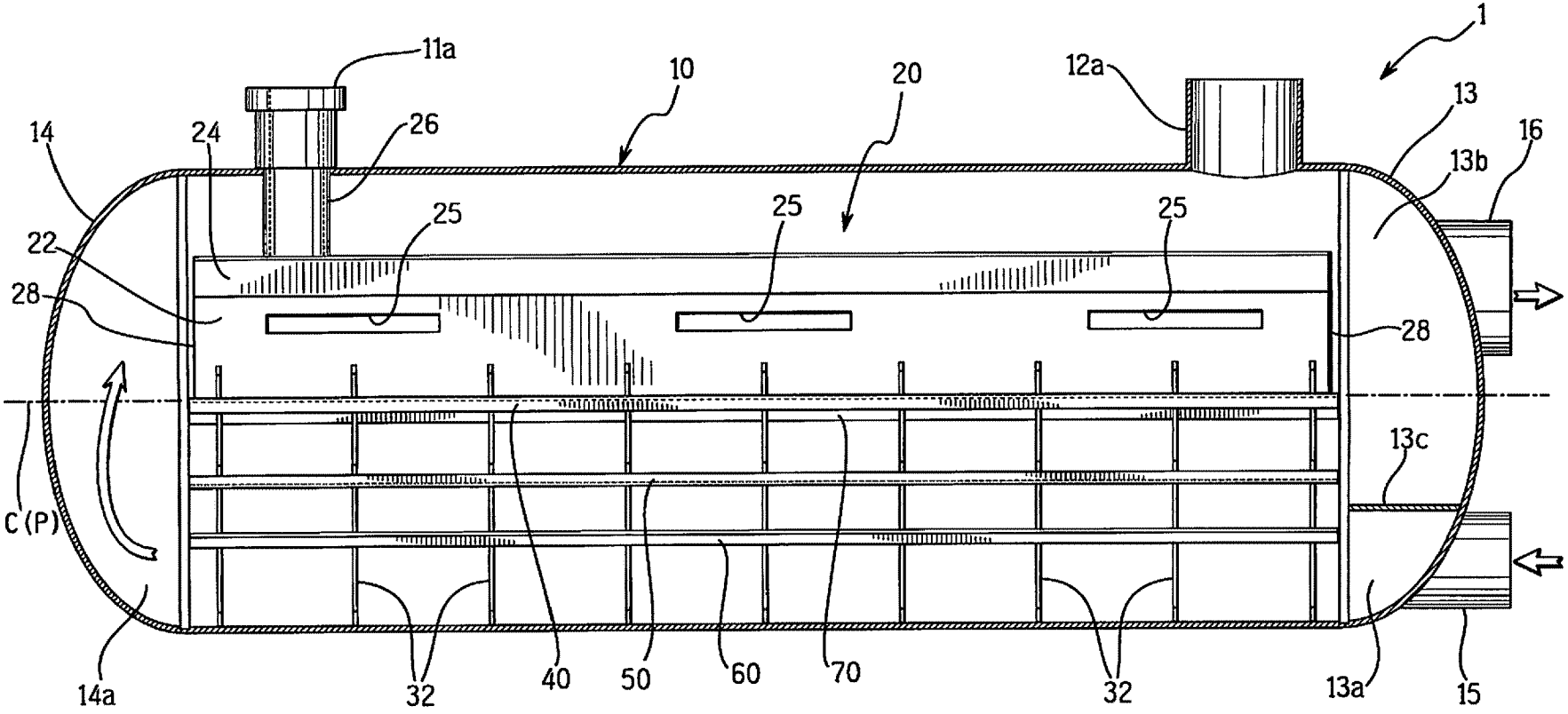
FIG. 4 is a simplified longitudinal cross sectional view of the heat exchanger illustrated in FIGS. 1-3, as taken along section line 4-4 in FIG. 3.
Figure 5:
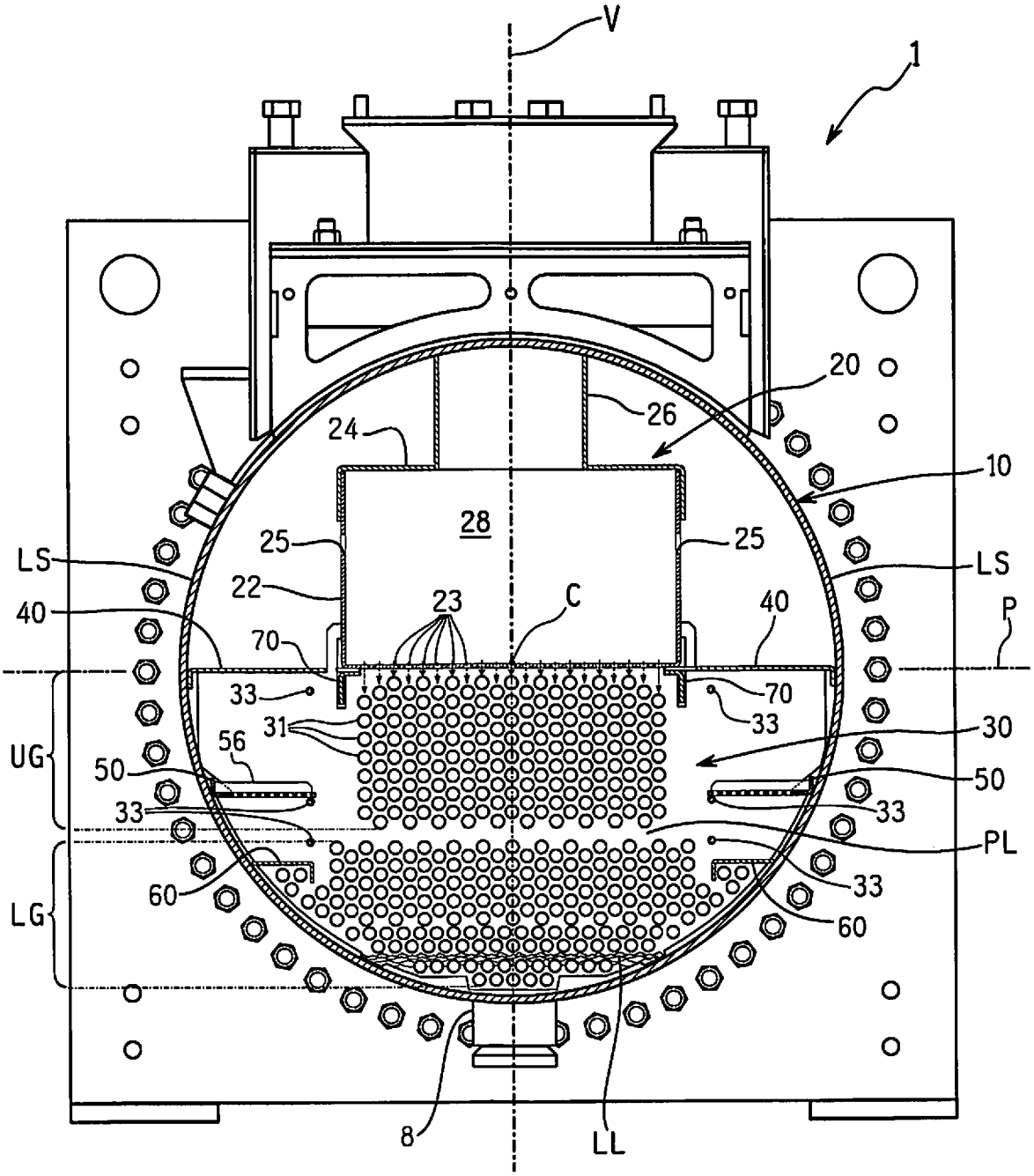
FIG. 5 is a simplified transverse cross sectional view of the heat exchanger illustrated in FIGS. 1-3, as taken along section line 5-5 in FIG. 3.

As shown in FIGS. 1 and 2, the vapor compression system includes the following four main components: an evaporator 1, a compressor 2, a condenser 3, an expansion device 4, and a control unit 5. The control unit 5 includes an electronic controller operatively coupled to a drive mechanism of the compressor 2 and the expansion device 4 to control operation of the vapor compression system. In the illustrated embodiment, as shown in FIGS. 4-5, the evaporator 1 includes a plurality of baffles 40, 50, 60 and 70 in accordance with the present invention, as explained below in more detail.

The evaporator 1 is a heat exchanger that removes heat from the liquid to be cooled (in this example, water) passing through the evaporator 1 to lower the temperature of the water as a circulating refrigerant evaporates in the evaporator 1. The refrigerant entering the evaporator 1 is typically in a two-phase gas/liquid state. The refrigerant at least includes liquid refrigerant. The liquid refrigerant evaporates as the vapor refrigerant in the evaporator 1 while absorbing heat from the water.

The low pressure, low temperature vapor refrigerant is discharged from the evaporator 1 and enters the compressor 2 by suction. In the compressor 2, the vapor refrigerant is compressed to the higher pressure, higher temperature vapor. The compressor 2 may be any type of conventional compressor, for example, centrifugal compressor, scroll compressor, reciprocating compressor, screw compressor, etc.

Next, the high temperature, high pressure vapor refrigerant enters the condenser 3, which is another heat exchanger that removes heat from the vapor refrigerant causing it to condense from a gas state to a liquid state. The condenser 3 may be an air-cooled type, a water-cooled type, or any suitable type of condenser. The heat raises the temperature of cooling water or air passing through the condenser 3, and the heat is rejected to outside of the system as being carried by the cooling water or air.

The condensed liquid refrigerant then enters through the expansion device 4 where the refrigerant undergoes an abrupt reduction in pressure. The expansion device 4 may be as simple as an orifice plate or as complicated as an electronic modulating thermal expansion valve. Whether the expansion device 4 is connected to the control unit 5 will depend on whether a controllable expansion device 4 is utilized. The abrupt pressure reduction usually results in partial evaporation of the liquid refrigerant, and thus, the refrigerant entering the evaporator 1 is usually in a two-phase gas/liquid state.

Some examples of refrigerants used in the vapor compression system are hydrofluorocarbon (HFC) based refrigerants, for example, R410A, R407C, and R134a, hydrofluoro olefin (HFO), unsaturated HFC based refrigerant, for example, R1234ze, and R1234yf, and natural refrigerants, for example, R717 and R718. R1234ze, and R1234yf are mid density refrigerants with densities similar to R134a. R450A and R513A are also possible refrigerants. A so-called Low Pressure Refrigerant (LPR) 1233zd is also a suitable type of refrigerant. Low Pressure Refrigerant (LPR) 1233zd is sometimes referred to as Low Density Refrigerant (LDR) because R1233zd has a lower vapor density than the other refrigerants mentioned above. R1233zd has a density lower than R134a, R1234ze, and R1234yf, which are so-called mid density refrigerants. The density being discussed here is vapor density not liquid density because R1233zd has a slightly higher liquid density than R134A. While the embodiment(s) disclosed herein are useful with any type of refrigerant, the embodiment(s) disclosed herein are particularly useful when used with LPR such as 1233zd. This is because a LPR such as R1233zd has a relatively lower vapor density than the other options, which leads to higher velocity vapor flow. Higher velocity vapor flow in a conventional device used with LPR such as R1233zd can lead to liquid carryover as mentioned in the Summary above. While individual refrigerants are mentioned above, it will be apparent to those skilled in the art from this disclosure that a combination refrigerant utilizing any two or more of the above refrigerants may be used. For example, a combined refrigerant including only a portion as R1233zd could be utilized.

It will be apparent to those skilled in the art from this disclosure that conventional compressor, condenser and expansion device may be used respectively as the compressor 2, the condenser 3 and the expansion device 4 in order to carry out the present invention. In other words, the compressor 2, the condenser 3 and the expansion device 4 are conventional components that are well known in the art. Since the compressor 2, the condenser 3 and the expansion device 4 are well known in the art, these structures will not be discussed or illustrated in detail herein. The vapor compression system may include a plurality of evaporators 1, compressors 2 and/or condensers 3.

Referring now to FIGS. 3-13, the detailed structure of the evaporator 1, which is the heat exchanger according to the first embodiment, will be explained. The evaporator 1 basically includes a shell 10, a refrigerant distributor 20, and a heat transferring unit 30. As mentioned above, in the illustrated embodiment, the evaporator 1 includes baffles 40, 50, 60 and 70. The baffles 40, 50, 60 and 70 can be considered to be parts of the heat transferring unit 30 or separate parts of the heat exchanger 1. In the illustrated embodiment, the heat transferring unit 30 is a tube bundle. Thus, the heat transferring unit 30 will also be referred to as the tube bundle 30 herein. Refrigerant enters the shell 10 and is supplied to the refrigerant distributor 20. Then refrigerant distributor 20 preferably performs gas liquid separation and supplies the liquid refrigerant onto the tube bundle 30, as explained in more detail below. Vapor refrigerant will exit the distributor 20 and flow into the interior of the shell 10, as also explained in more detail below. The baffles 40, 50, 60 and 70 assist in controlling the flow of the refrigerant vapor within the shell 10, as explained in more detail below.

Figure 3:
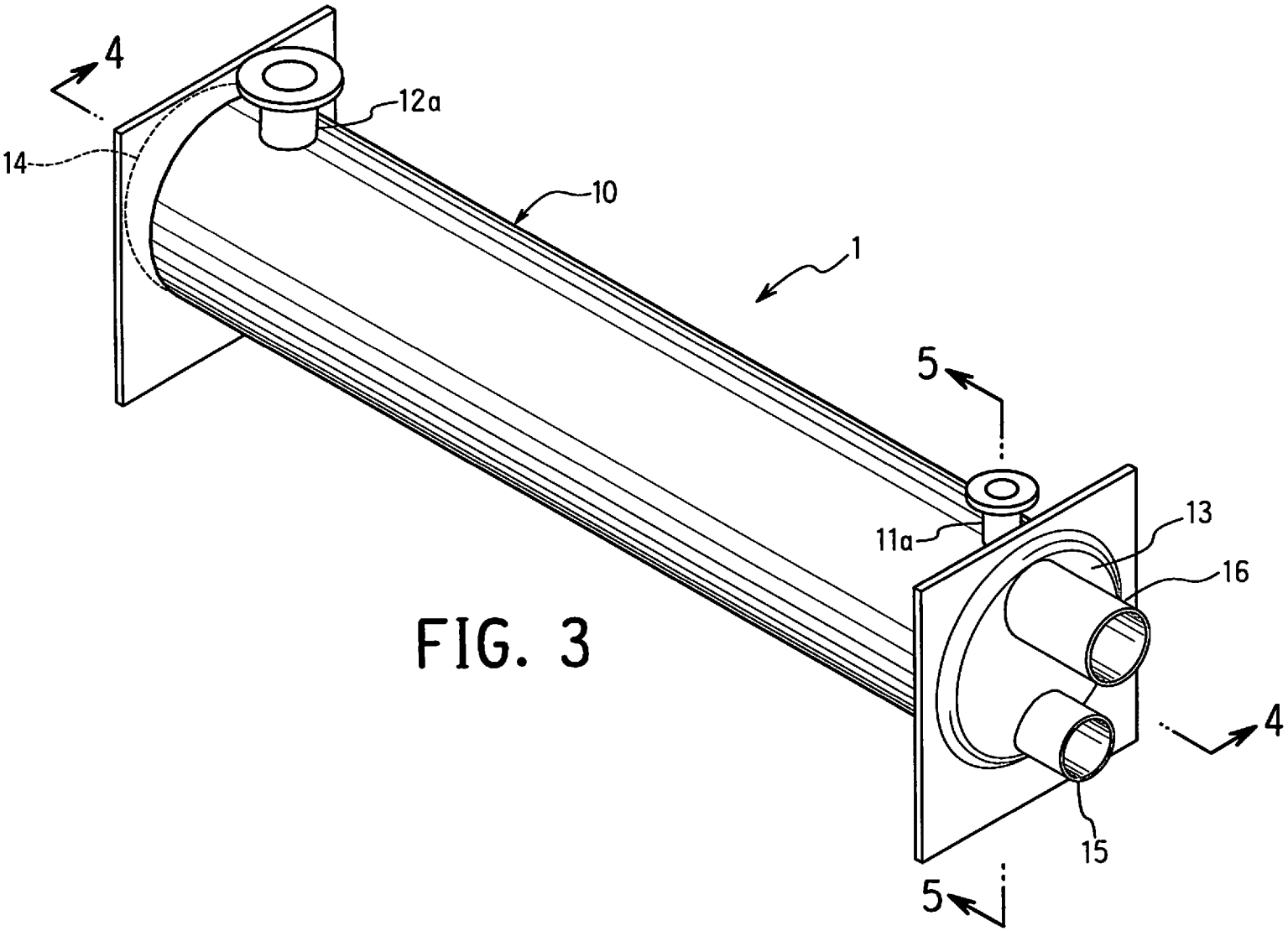
FIG. 3 is a simplified perspective view of the heat exchanger according to the first embodiment of the present invention.

As best understood from FIGS. 3-5, in the illustrated embodiment, the shell 10 has a generally cylindrical shape with a curved lateral sides LS and a longitudinal center axis C (FIG. 5) extending substantially in the horizontal direction. The lateral sides LS are mirror images of each other and can be referred to as first and/or second lateral sides, and vice versa. Thus, the shell 10 extends generally parallel to a horizontal plane P. The shell 10 includes a connection head member 13 defining an inlet water chamber 13*a* and an outlet water chamber 13*b*, and a return head member 14 defining a water chamber 14*a*. The connection head member 13 and the return head member 14 are fixedly coupled to longitudinal ends of a cylindrical body of the shell 10. The inlet water chamber 13*a* and the outlet water chamber 13*b* are partitioned by a water baffle 13*c*. The connection head member 13 includes a water inlet pipe 15 through which water enters the shell 10 and a water outlet pipe 16 through which the water is discharged from the shell 10.

As shown in FIGS. 1-5, the shell 10 further includes a refrigerant inlet 11*a* connected to a refrigerant inlet pipe 11*b* and a shell refrigerant vapor outlet 12*a* connected to a refrigerant outlet pipe 12*b*. The refrigerant inlet pipe 11*b* is fluidly connected to the expansion device 4 to introduce the two-phase refrigerant into the shell 10. The expansion device 4 may be directly coupled at the refrigerant inlet pipe 11*b*. Thus, the shell 10 has a refrigerant inlet 11*a* that at least refrigerant with liquid refrigerant flows therethrough and a shell refrigerant vapor outlet 12*a*, with the longitudinal center axis C of the shell 10 extending substantially parallel to the horizontal plane P. The liquid component in the two-phase refrigerant boils and/or evaporates in the evaporator 1 and goes through phase change from liquid to vapor as it absorbs heat from the water passing through the evaporator 1. The vapor refrigerant is drawn from the refrigerant outlet pipe 12*b* to the compressor 2 by suction of the compressor 2. The refrigerant that enters the refrigerant inlet 11*a* includes at least liquid refrigerant. Often the refrigerant entering the refrigerant inlet 11*a* is two-phase refrigerant. From the refrigerant inlet 11*a* the refrigerant flows into the refrigerant distributor 20, which distributes the liquid refrigerant over the tube bundle 30.

Referring now to FIGS. 4-5, the refrigerant distributor 20 is fluidly communicating with the refrigerant inlet 11*a* and is disposed within the shell 10. The refrigerant distributor 20 is preferably configured and arranged to serve as both a gas-liquid separator and a liquid refrigerant distributor. The refrigerant distributor 20 extends longitudinally within the shell 10 generally parallel to the longitudinal center axis C of the shell 10. As best shown in FIGS. 4-5, the refrigerant distributor 20 includes a bottom tray part 22 and a top lid part 24. An inlet tube 26 is connected to the top lid part 24 and the refrigerant inlet 11*a* to fluidly communicate the refrigerant inlet 11*a* with the refrigerant distributor 20. The bottom tray part 22 and the top lid part 24 are rigidly connected together to form a tubular shape. End parts 28 may be optionally attached to opposite longitudinal ends of the bottom tray part 22 and the top lid part 24. The refrigerant distributor 20 is supported by parts of the tube bundle 30, as explained in more detail below.

The precise structure of the refrigerant distributor 20 is not critical to the present invention. Therefore, it will be apparent to those skilled in the art from this disclosure that any suitable conventional refrigerant distributor 20 can be used. However, as seen in FIG. 5 preferably the refrigerant distributor 20 includes at least one liquid refrigerant distribution opening 23 that distributes liquid refrigerant. In the illustrated embodiment, the bottom tray part 22 includes a plurality of liquid refrigerant distribution openings 23 that distribute liquid refrigerant onto the tube bundle 30. In addition, in the illustrated embodiment, as seen in FIG. 4 the refrigerant distributor 20 preferably includes at least one gas or vapor refrigerant distribution opening 25. In the illustrated embodiment, the bottom tray part 22 includes a plurality of gas or vapor refrigerant distribution openings 25 that distribute vapor refrigerant into the shell 10, which exits the shell 10 through the shell refrigerant vapor outlet 12*a* together with refrigerant that has evaporated due contact with the tube bundle 30. The vapor refrigerant distribution openings 25 are disposed above a liquid level of refrigerant (not shown) in the refrigerant distributor 20. Because the precise structure of the refrigerant distributor 20 is not critical to the present invention, the refrigerant distributor 20 will not be explained or illustrated in further detail herein.

Referring now to FIGS. 4-7, the heat transferring unit 30 (tube bundle) will now be explained in more detail. The tube bundle 30 is disposed inside the shell 10 below the refrigerant distributor 20 so that the liquid refrigerant discharged from the refrigerant distributor 20 is supplied onto the tube bundle 30. The tube bundle 30 includes a plurality of heat transfer tubes 31 that extend generally parallel to the longitudinal center axis C of the shell 10 as best understood from FIGS. 4-6. The heat transfer tubes 31 are grouped together, as explained in more detail below. The heat transfer tubes 31 are made of materials having high thermal conductivity, such as metal. The heat transfer tubes 31 are preferably provided with interior and exterior grooves to further promote heat exchange between the refrigerant and the water flowing inside the heat transfer tubes 31. Such heat transfer tubes including the interior and exterior grooves are well known in the art. For example, GEWA-B tubes by Wieland Copper Products, LLC may be used as the heat transfer tubes 31 of this embodiment.

Figure 6:
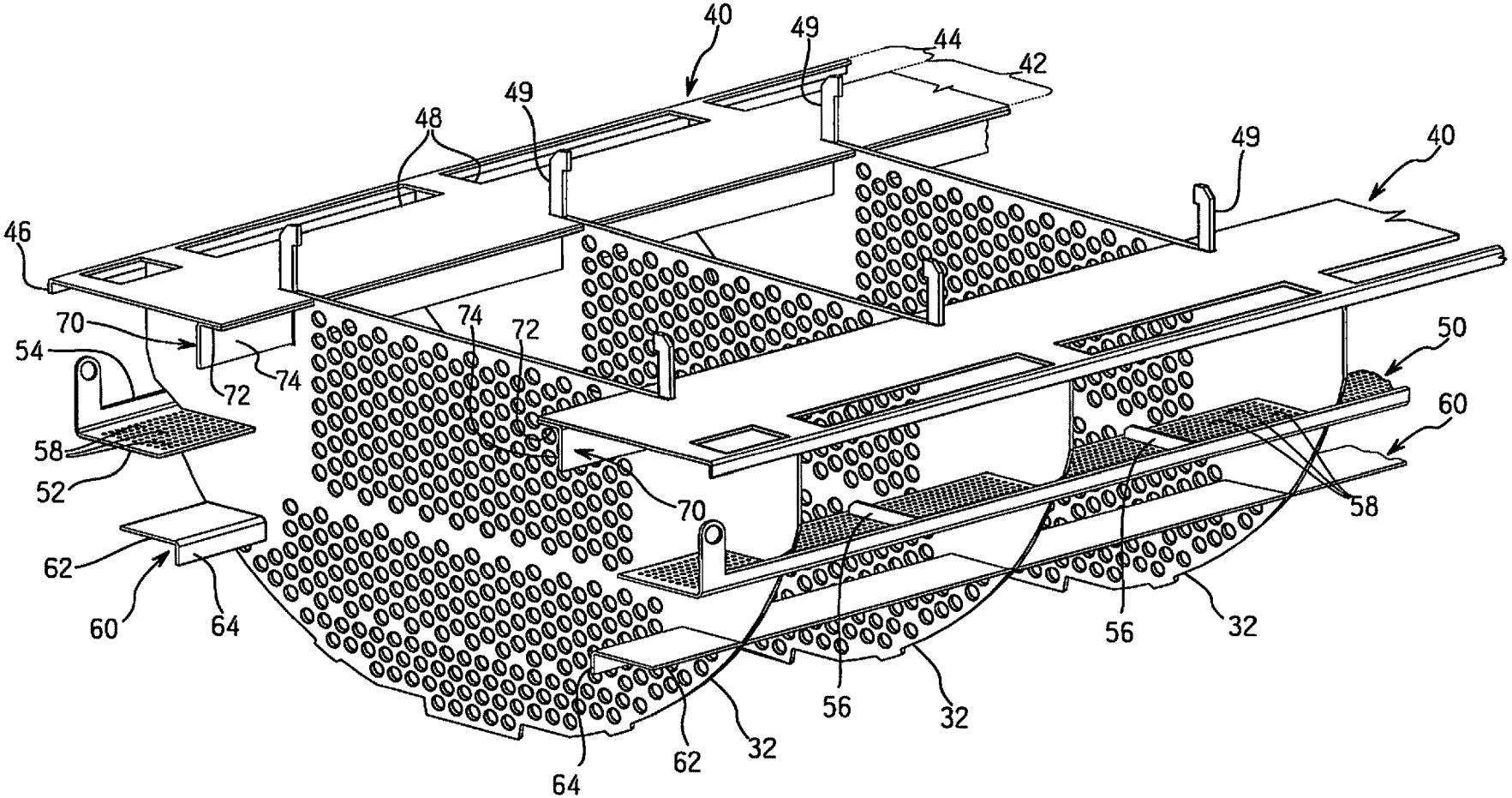
FIG. 6 is an enlarged partial perspective view of several tube supports and baffles of the heat exchanger illustrated in FIGS. 1-5.

As best understood from FIGS. 4-6, the heat transfer tubes 31 are supported by a plurality of vertically extending support plates 32 in a conventional manner. The support plates 32 may be fixedly coupled to the shell 10 or may merely rest within the shell 10. The support plates 32 also support bottom tray part 22 in order to support the refrigerant distributor 20. More specifically, the refrigerant distributor 20 via the bottom tray part 22 may be fixedly attached to the support plates 32 or merely rest on the support plates 32. In addition, the support plates 32 support the baffles 40, 50, 60 and 70 as seen in FIGS. 4-6. In FIG. 4, the heat transfer tubes 31 are removed in order to better illustrate how the baffles 40, 50, 60 and 70 are supported by the support plates 32.

In this embodiment, the tube bundle 30 is arranged to form a two-pass system, in which the heat transfer tubes 31 are divided into a supply line group disposed in a lower portion of the tube bundle 30, and a return line group disposed in an upper portion of the tube bundle 30. Thus, the plurality of heat transfer tubes 31 are grouped to form an upper group UG and a lower group LG with a pass lane PL disposed between the upper group UG and the lower group LG as seen in FIG. 5. As understood from FIGS. 4-5, inlet ends of the heat transfer tubes 31 in the supply line group are fluidly connected to the water inlet pipe 15 via the inlet water chamber 13*a* of the connection head member 13 so that water entering the evaporator 1 is distributed into the heat transfer tubes 31 in the supply line group. Outlet ends of the heat transfer tubes 31 in the supply line group and inlet ends of the heat transfer tubes 31 of the return line tubes are fluidly communicated with a water chamber 14*a* of the return head member 14.

Therefore, the water flowing inside the heat transfer tubes 31 in the supply line group (lower group LG) is discharged into the water chamber 14*a*, and redistributed into the heat transfer tubes 31 in the return line group (upper group UG). Outlet ends of the heat transfer tubes 31 in the return line group are fluidly communicated with the water outlet pipe 16 via the outlet water chamber 13*b* of the connection head member 13. Thus, the water flowing inside the heat transfer tubes 31 in the return line group exits the evaporator 1 through the water outlet pipe 16. In a typical two-pass evaporator, the temperature of the water entering at the water inlet pipe 15 may be about 54 degrees F. (about 12° C.), and the water is cooled to about 44 degrees F. (about 7° C.) when it exits from the water outlet pipe 16.

As shown in FIG. 5, the tube bundle 30 of the illustrated embodiment is a hybrid tube bundle including a falling film region and a flooded region below a liquid level LL. The liquid level LL illustrated is a minimum liquid level. However, the liquid level could be higher, for example covering two more rows of the heat transfer tubes 31 in the supply line group (lower group LG). The heat transfer tubes 31 not submerged in liquid refrigerant form the tubes in the falling film region. The heat transfer tubes 31 in the falling film region are configured and arranged to perform falling film evaporation of the liquid refrigerant. More specifically, the heat transfer tubes 31 in the falling film region are arranged such that the liquid refrigerant discharged from the refrigerant distributor 20 forms a layer (or a film) along an exterior wall of each of the heat transfer tubes 31, where the liquid refrigerant evaporates as vapor refrigerant while it absorbs heat from the water flowing inside the heat transfer tubes 31. As shown in FIG. 5, the heat transfer tubes 31 in the falling film region are arranged in a plurality of vertical columns extending parallel to each other when seen in a direction parallel to the longitudinal center axis C of the shell 10 (as shown in FIG. 5). Therefore, the refrigerant falls downwardly from one heat transfer tube to another by force of gravity in each of the columns of the heat transfer tubes 31. The columns of the heat transfer tubes 31 are disposed with respect to the liquid refrigerant distribution opening 23 of the refrigerant distributor 20 so that the liquid refrigerant discharged from the liquid refrigerant distribution opening 23 is deposited onto an uppermost one of the heat transfer tubes 31 in each of the columns.

The liquid refrigerant that did not evaporate in the falling film region continues falling downwardly by force of gravity into the flooded region. The flooded region includes the plurality of the heat transfer tubes 31 disposed in a group below the falling film region at the bottom portion of the hub shell 11. For example, the bottom, one, two, three or four rows of tubes 31 can be disposed as part of the flooded region depending on the amount of refrigerant charged in the system. Since the refrigerant entering the supply line group (lower group LG) of the heat transfer tubes 31 may be about 54 degrees F. (about 12° C.), liquid refrigerant in the flooded region may still boil and evaporate.

In this embodiment, a fluid conduit 8 may be fluidly connected to the flooded region within the shell 10. A pump device (not shown) may be connected to the fluid conduit 8 to return the fluid from the bottom of the shell 10 to the compressor 2 or may be branched to the inlet pipe 11*b* to be supplied back to the refrigerant distributor 20. The pump can be selectively operated when the liquid accumulated in the flooded region reaches a prescribed level to discharge the liquid therefrom to outside of the evaporator 1. In the illustrated embodiment, the fluid conduit 8 is connected to a bottom most point of the flooded region. However, it will be apparent to those skilled in the art from this disclosure that the fluid conduit 8 can be fluidly connected to the flooded region at any location between the bottom most point of the flooded region and a location corresponding to the liquid level LL in the flooded region (e.g., between the bottom most point and the top tier of tubes 31 in the flooded region). Moreover, it will be apparent to those skilled in the art from this disclosure that the pump device (not shown) could instead be an ejector (not shown). In the case, where the pump device is replaced with an ejector, the ejector also receives compressed refrigerant from the compressor 2. The ejector can then mix the compressed refrigerant from the compressor 2 with the liquid received from the flooded region so that a particular oil concentration can be supplied back to the compressor 2. Pumps and ejectors such as those mentioned above are well known in the art and thus, will not be explained or illustrated in further detail herein.

Referring now to FIGS. 4-13, the baffles 40, 50, 60 and 70 will now be explained in more detail. In the illustrated embodiment, the evaporator includes a pair of upper baffles 40, a pair of intermediate baffles 50, a pair of lower baffles 60, and a pair of upright baffles 70. The pair of upper baffles 40 are disposed on opposite lateral sides of the refrigerant distributor 20 and the tube bundle 30 at the top of the tube bundle 30. The pair of intermediate baffles 50 are disposed on opposite lateral sides of the tube bundle 30 below the upper baffles 40. The pair of lower baffles 60 are disposed on opposite lateral sides of the tube bundle 30 below the intermediate baffles 50. The pair of upright baffles 70 are disposed on opposite lateral sides of the tube bundle 30 below the refrigerant distributor 20 at inner ends of the upper baffles 40.

Figure 13:
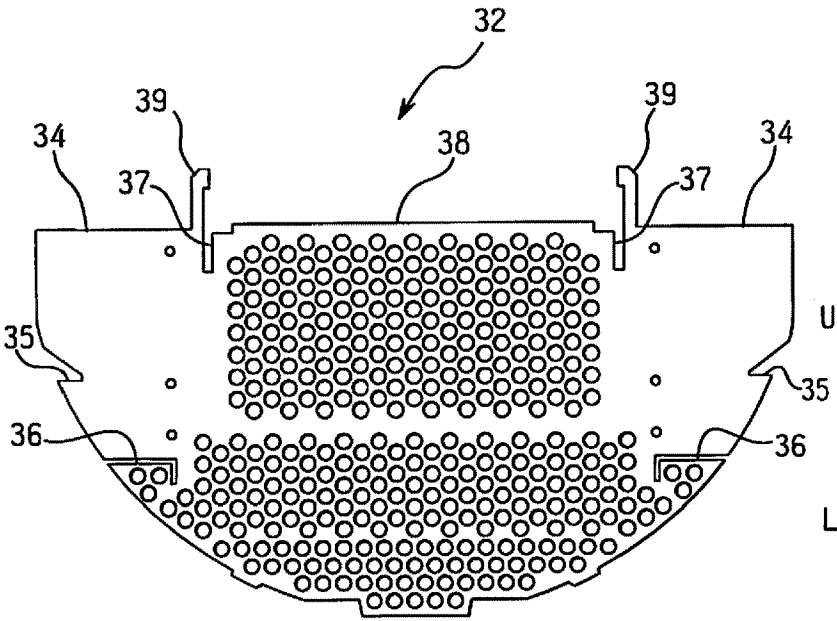
FIG. 13 is an elevational view of one of the tube support plates illustrated in FIG. 6.

The baffles 40, 50, 60 and 70 are supported by the tube support plates 32. Specifically, in the illustrated embodiment, each tube support plate 32 has a pair of laterally spaced upper surfaces 34, a pair of laterally spaced intermediate slots 35, a pair of laterally spaced lower slots 36, and a pair of upper slots 37, as best seen in FIG. 13. The pair of laterally spaced upper surfaces 34 support the upper baffles 40, the pair of laterally spaced intermediate slots 35 support the intermediate baffles 50, the pair of laterally spaced lower slots 36 support the lower baffles 60, and the pair of upper slots 37 support the upright baffles 70, as best understood from FIGS. 4-7 and 13.

Referring now to FIGS. 4-9, the upper baffles 40 will now be explained in more detail. As mentioned above, in the illustrated embodiment, the heat exchanger 1 includes a pair of upper baffles 40, with one of the upper baffles 40 disposed on each lateral side of the refrigerant distributor 20 and the tube bundle 30. The upper baffles 40 are identical to each other. However, the upper baffles 40 are mounted to face each other in a mirror image arrangement relative to a vertical plane V passing through the central axis C, as best understood from FIGS. 5-6. Therefore, only one of the upper baffles 40 will be discussed and/or illustrated in detail herein. However, it will be apparent to those having ordinary skill in the art that the descriptions and illustrations of one of the upper baffles 40 also applies to the other upper baffle 40. In addition, it will be apparent that either of the upper baffles 40 could be referred to as a first upper baffle 40 and either of the upper baffles 40 could be referred to a second upper baffle 40, and vice versa.

The upper baffle 40 includes an inner portion 42, an outer portion 44 extending laterally outwardly from the inner portion 42, and a flange portion 46 extending downwardly from the outer edge of the outer portion 44, as best seen in FIG. 6. In the illustrated embodiment, the inner portion 42, the outer portion 44 and the flange portion 46 are each formed of a rigid sheet/plate material such as metal, which prevents liquid and gas refrigerant from passing therethrough unless holes 48 are formed therein. In addition, in the illustrated embodiment, the inner portion 42, the outer portion 44 and the flange portion 46 are integrally formed together as a one-piece unitary member. However, it will be apparent to those skilled in the art from this disclosure that these plates 42, 44 and 46 may be constructed as separate members, which are attached to each other using any conventional technique such as welding. In either case, the inner portion 42 is preferably a solid, non-permeable portion that blocks liquid and gas refrigerant from passing therethrough. On the other hand, the outer portion 44 is preferably a permeable portion that allows liquid and gas refrigerant to pass therethrough. The flange portion 46 can be permeable or non-permeable.

Referring still to FIGS. 4-9, the inner portion 42 has an inner edge disposed under the refrigerant distributor 20 and above the adjacent upright baffle 70. Thus, the baffle 40 is sandwiched between the refrigerant distributor 20 and upright baffle 70. In addition, the inner portion 42 and the outer portion 44 are supported on the upper surfaces 34 of the tube support plates 32. The flange portion 46 abuts a lateral side of the shell 10 at the outside of the tube support plates 32. In the illustrated embodiment, the outer portions 44 are solid at the locations above the tube support plates 32, as best understood from FIGS. 6 and 9. The inner portion 42 includes slots 49 (FIG. 7) arranged to receive support flanges 39 of the tube support plates 32 (FIG. 13). The support flanges 39 extend upwardly from the upper surfaces 34. The support flanges 39 are arranged to laterally support the refrigerant distributor 20 therebetween.

Figure 8:
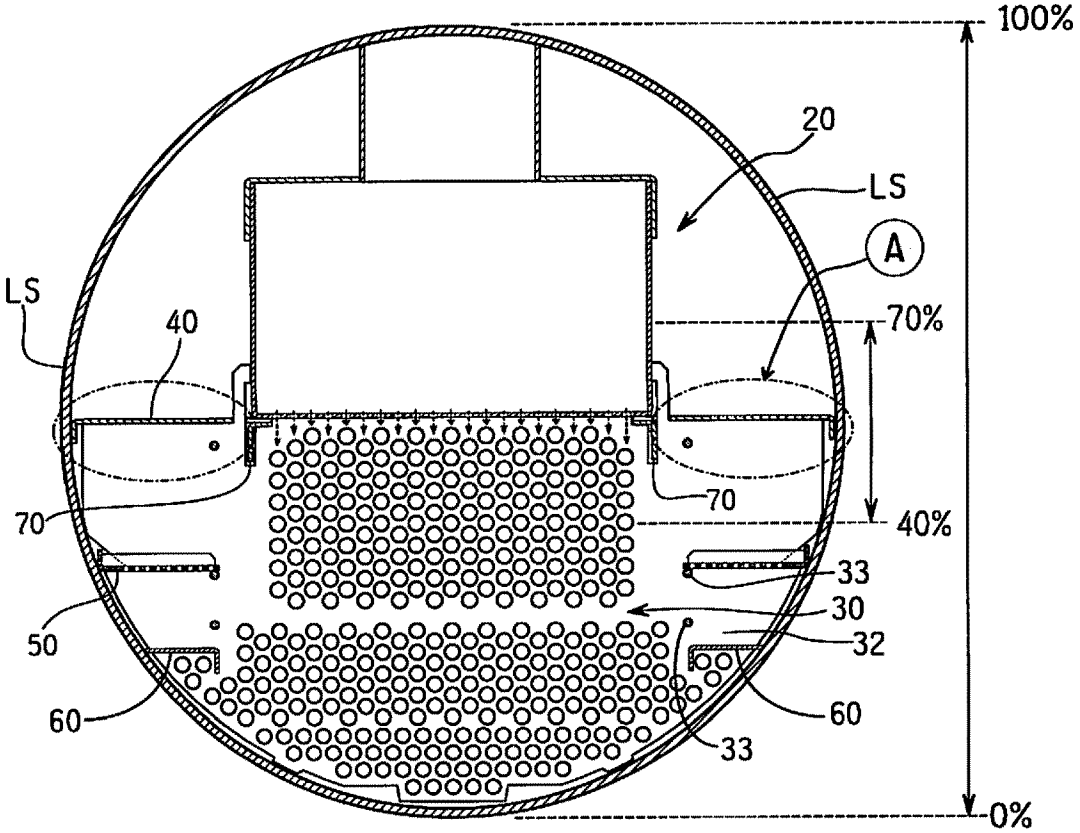
FIG. 8 is an enlarged partial view of the arrangement of FIG. 5, but with vertical dimensional ranges for the upper baffle shown for the purpose of illustration.

The inner portion 42 and the outer portion 44 of the upper baffle 40 have a coplanar arrangement substantially parallel to the horizontal plane P. The inner portion 42 and the outer portion 44 of the upper baffle 40 are disposed upwardly from a bottom of the shell 10 between 40% and 70% of an overall height of the shell 10. In the illustrated embodiment, the inner portion 42 and the outer portion 44 of the upper baffle 40 are disposed upwardly from a bottom of the shell 10 about 55% of an overall height of the shell 10. The upper surfaces 34 of the tube support plates 32 are located slightly above the top of the tube bundle 30 at about the same height as the upper baffle 40 as seen in FIG. 8.

Figure 7:
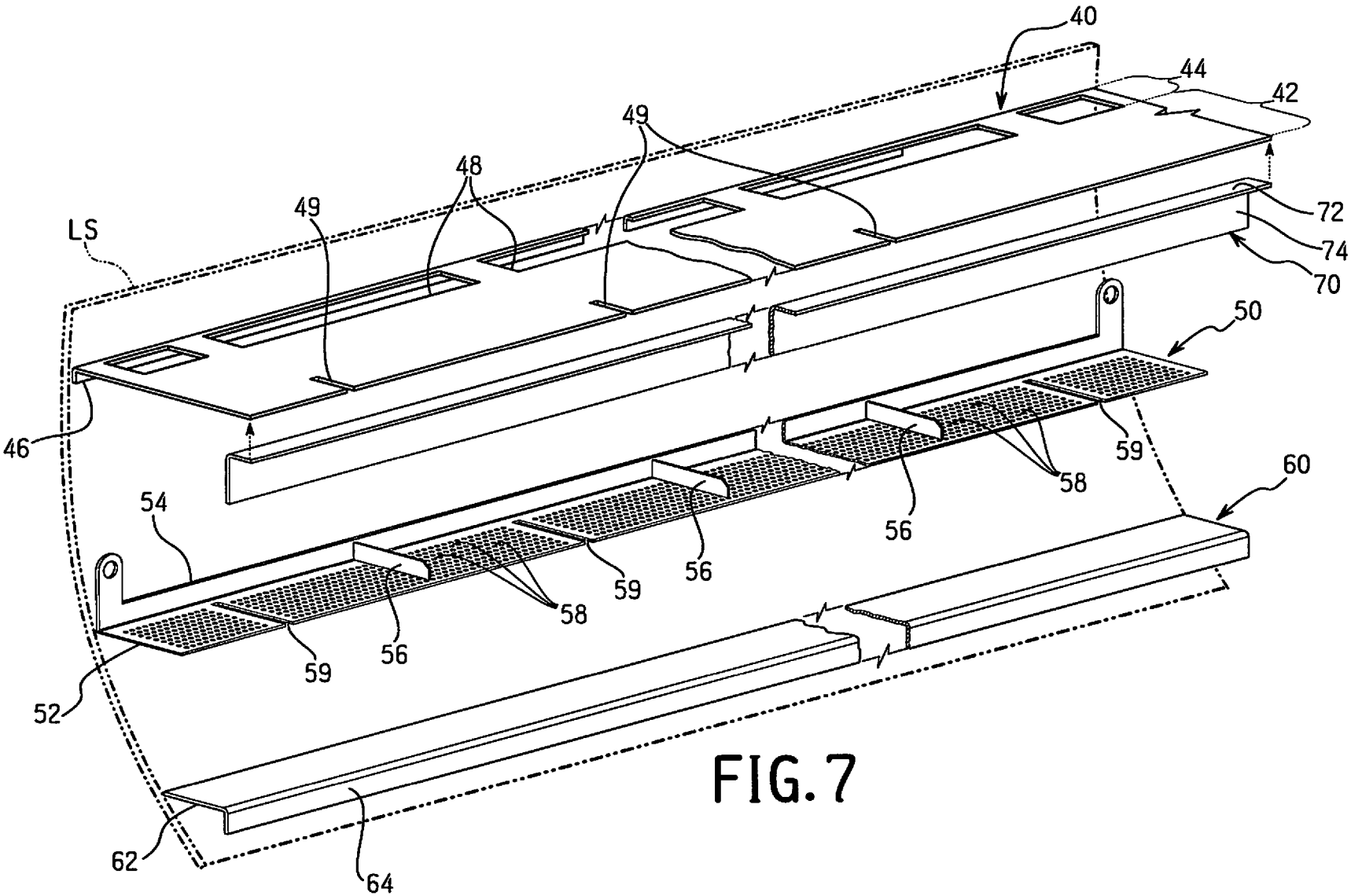
FIG. 7 is an exploded perspective view of some of the baffles of the heat exchanger illustrated in FIG. 1-6.

As best understood from FIG. 7, in the illustrated embodiment, the outer portion 44 is constructed of the same non-permeable material as the inner portion 42 but with the openings 48 formed therein to allow liquid and gas refrigerant to pass therethrough. Due to this structure, the outer portion 44 generally does not obstruct the flow of refrigerant therethrough. The openings 48 from a majority of the area of the outer portion 44 and preferably more than 75% of the area of the outer portion 44 to allow this free unobstructed flow of refrigerant. The openings 48 are relatively small in number and large in size to achieve this. More specifically, in the illustrated embodiment, each opening 48 has a lateral width that is equal to a lateral width of the outer portion 44. In the illustrated embodiment, a single opening 48 is disposed between adjacent tube support plates 32 with the end openings 48 being cut longitudinally shorter, as best seen in FIG. 7.

Figure 9:
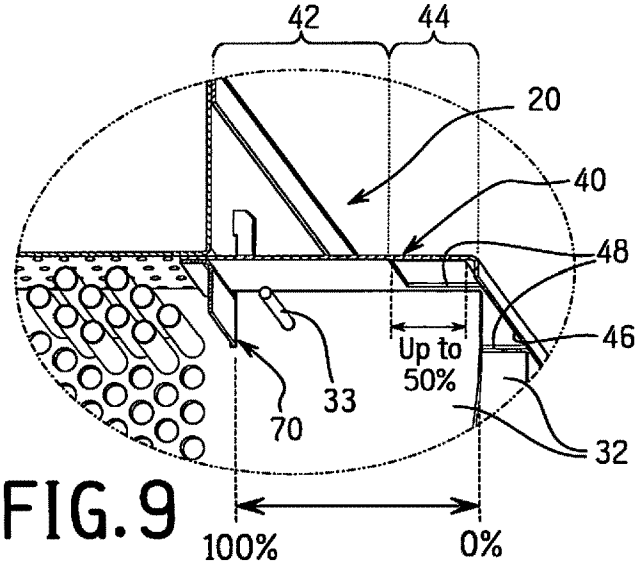
FIG. 9 is a further enlarged view of the circled section A in FIG. 8 with lateral dimensions of the upper baffle indicated thereon.

Still referring to FIGS. 4-9, the outer portion 44 and the flange portion 46 may even be eliminated so that a permeable outer portion is formed by the empty space between the inner portion 42 and the shell 10. However, in the illustrated embodiment, the outer portion 44 and the flange portion 46 are included and can assist in mounting and stability of the inner portion 42 of the baffle 40. Regardless, the permeable portion (e.g. outer portion 44) preferably has a lateral width no more than 50% of a distance between the shell 10 and the adjacent upright baffle 70. In addition, the permeable portion (e.g. outer portion 44) preferably has a lateral width no more than 50% of a distance between the shell 10 and the adjacent part of the refrigerant distributor 20. In the illustrated embodiment, the adjacent upright baffle 70 is aligned with the adjacent lateral side of the refrigerant distributor 20 as seen in FIG. 9.

The function(s) of the upper baffles 40 will now be explained in more detail. Because the upper baffles 40 are located between the tube bundle 30 and the shell refrigerant vapor outlet 12*a* where refrigerant vapor is sucked out of the shell 10, all of the evaporated vapor must flow through the upper baffles 40. The upper baffles function to even out the vapor flow near the top of the falling film bank by restricting upward vapor flow. The solid area of the inner portion 42 does not allow refrigerant flow to slip off of tube bank, and forces high speed flow at top of tube bundle 30 to mix with lower speed flow in the rest of shell 10. The open area at the outer portion 44 allows for vapor that has been evaporated off of the tube bundle 30 to mix with vapor above the refrigerant distributor 20. Although the illustrated embodiment shows as all the same size openings, different sizes can be provided to direct vapor flow.

As is understood from the above descriptions, the upper baffles 40 are vertically disposed at a top of the tube bundle 30, with the upper baffles 40 extending laterally outwardly from the tube bundle 30 toward a first lateral side LS of the shell 10. In addition, preferably the upper baffles include upper non-permeable portions 42 laterally disposed adjacent to the tube bundle 30 and upper permeable portions 44 laterally disposed outwardly of the upper non-permeable portions 42, with the upper permeable portions 44 being adjacent to the lateral sides LS of the shell 10. In addition, preferably, the upper permeable portions 44 have lateral widths less than 50% of overall lateral widths of the upper baffles 40. Therefore, the upper non-permeable portions have lateral widths larger than the lateral widths of the upper permeable portions, respectively. Also, as mentioned above, the upper baffles 40 are preferably formed of a non-permeable material with holes 48 formed therein to form the upper permeable portions 44. Also, as mentioned above, the upper baffles 40 are preferably vertically disposed at a bottom of the refrigerant distributor 20, and may be attached to a bottom of the refrigerant distributor 20. In the illustrated embodiment, the upper baffles 40 are preferably vertically supported by at least one tube support 32 that supports the tube bundle 30. The upper baffles are vertically disposed 40% to 70% of an overall height of the shell above a bottom edge of the shell.

As mentioned above, in the illustrated embodiment, a pair of upper baffles 40 are preferably present that are mirror images of each other. However, one upper baffle 40 can provide benefits, and thus, the heat exchanger 1 preferably includes at least one upper baffle 40, and does not necessarily require both.

Referring now to FIGS. 4-7 and 11, the intermediate baffles 50 will now be explained in more detail. As mentioned above, in the illustrated embodiment, the heat exchanger 1 includes a pair of intermediate baffles 50, with one of the intermediate baffles 50 disposed on each lateral side of the refrigerant distributor 20 and the tube bundle 30. The intermediate baffles 50 are identical to each other. However, the intermediate baffles 50 are mounted to face each other in a mirror image arrangement relative to the vertical plane V passing through the central axis C, as best understood from FIGS. 5-6. Therefore, only one of the intermediate baffles 50 will be discussed and/or illustrated in detail herein. However, it will be apparent to those having ordinary skill in the art that the descriptions and illustrations of one of the intermediate baffles 50 also applies to the other intermediate baffle 50. In addition, it will be apparent that either of the intermediate baffles 50 could be referred to as a first intermediate baffle 50 and either of the intermediate baffles 50 could be referred to a second intermediate baffle 50, and vice versa. Even though the baffles 50 are referred to as intermediate baffles 50, the baffles 50 could also be considered lower baffles as compared to the upper baffles 40, and the baffles 50 could also be considered upper baffles as compared to the lower baffles 60. In other words, the relative position of the intermediate baffles 50 depends on their locations relative to other parts.

The intermediate baffle 50 includes main portion 52, an outer flange portion 54 extending upwardly from the outer edge of the main portion 52, and reinforcing ribs 56 mounted to the main portion 52. In the illustrated embodiment, the main portion 52 and the outer flange portion 54 are each formed of a rigid sheet/plate material such as metal, which prevents liquid and gas refrigerant from passing therethrough unless holes 58 are formed therein. In addition, in the illustrated embodiment, the main portion 52 and the outer flange portion 54 are integrally formed together as a one-piece unitary member. However, it will be apparent to those skilled in the art from this disclosure that these plates 52 and 54 may be constructed as separate members, which are attached to each other using any conventional technique such as welding. In either case, the main portion 52 is preferably a permeable portion that allows liquid and gas refrigerant to pass therethrough, except at the outer edge thereof. The outer flange portion 54 can be permeable or non-permeable. However, in the illustrated embodiment, the outer flange portion 54 is non-permeable for a more rigid outer portion than if constructed of permeable material. The reinforcing ribs 56 are preferably separate members constructed of the same material as the main portion 52 and are mounted to provide added strength at locations spaced from the tube support plates 32.

Figure 11:
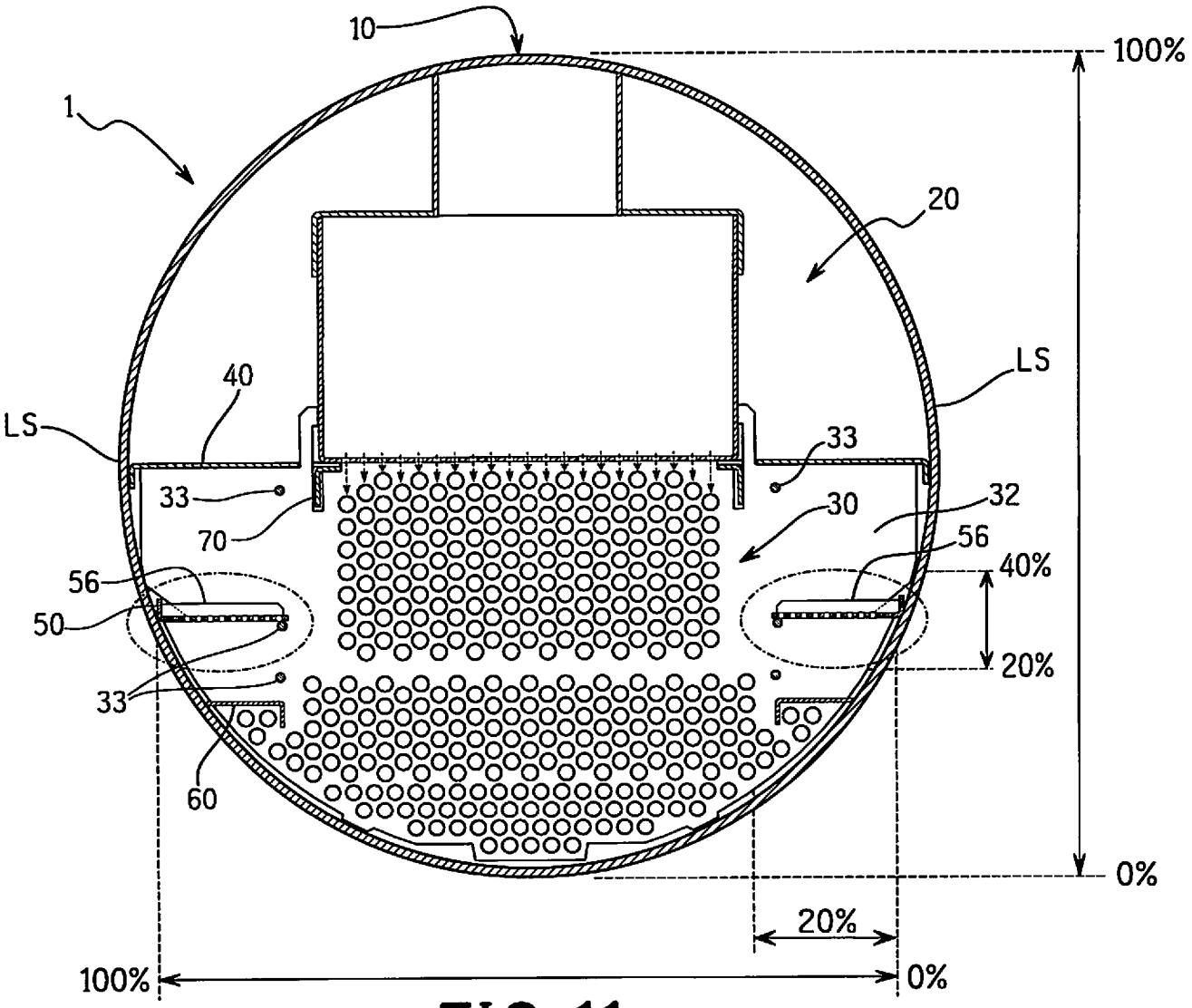
FIG. 11 is an enlarged partial view of the arrangement of FIG. 5, but with vertical and lateral dimensional ranges for the middle baffle shown for the purpose of illustration.
Figure 12:
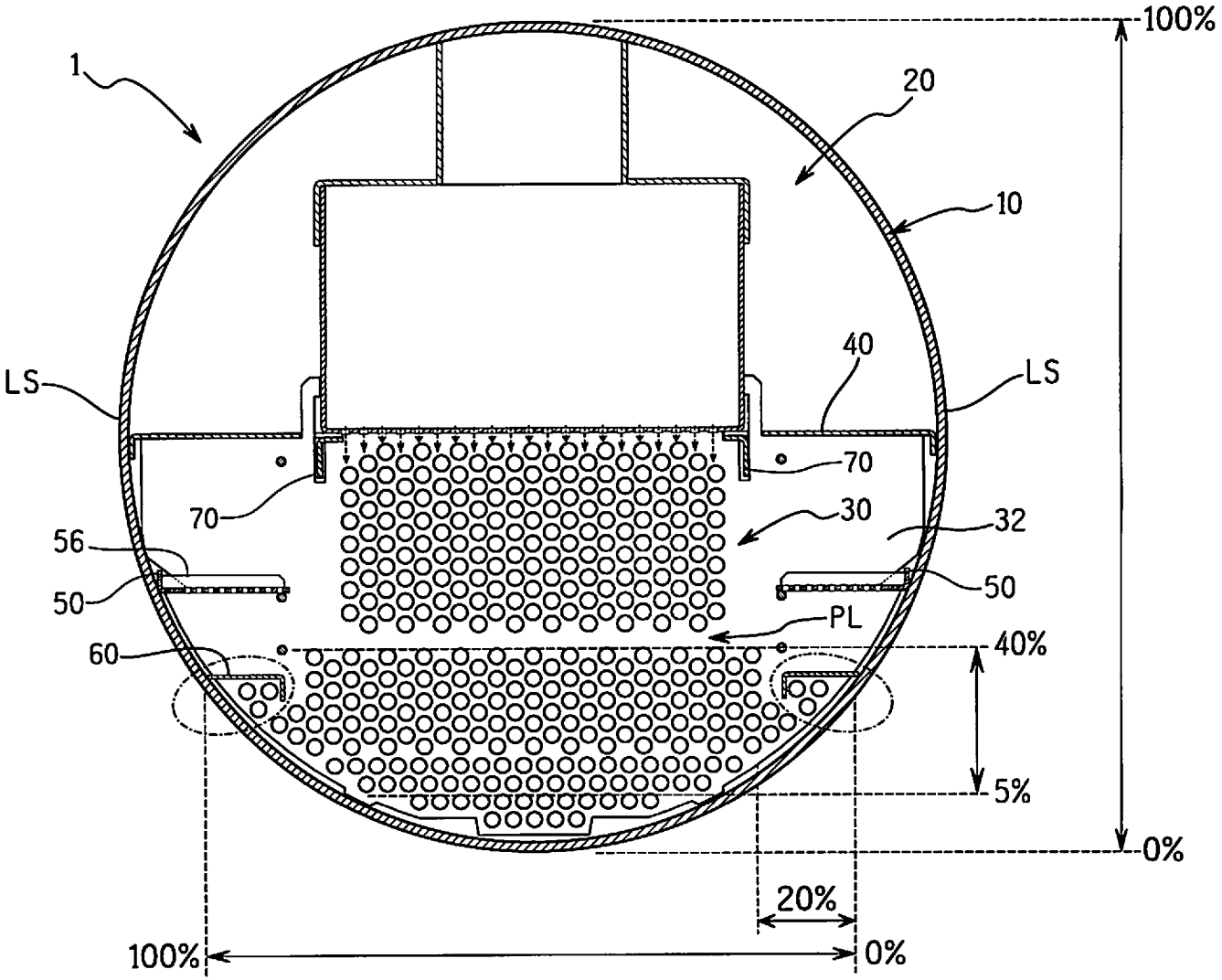
FIG. 12 is an enlarged partial view of the arrangement of FIG. 5, but with vertical and lateral dimensional ranges for the lower baffle shown for the purpose of illustration.

Referring still to FIGS. 4-7 and 11, the main portion 52 has a plurality of longitudinally spaced slots 59 that receive the tube support plates 32 therein. In addition, the main portion 52 and the outer flange portion 54 are supported by the groove 35 of the tube support plates 32 at the outer end of the intermediate baffle 50. The inner part of the main portion 52 is vertically supported by one of a plurality of reinforcing bars 33 (six shown) supporting the tube support plates 32, as seen in FIG. 11. FIG. 6 has the reinforcing bars 33 omitted for the sake of convenience. In the illustrated embodiment, the outer flange portion 54 is solid along with the outer edge of the main portion 52 as best understood from FIGS. 6 and 11. The main portion 52 includes a plurality of the holes 58 formed therein. In the illustrated embodiments, the holes 58 are large in number but small in size. In the illustrated embodiment, the holes 58 are smaller in diameter than a diameter of the heat transfer tubes 31. However, the holes 58 could be elongated slots and/or the main portion 52 can have a louvered configuration. The outer flange 54 preferably includes a pair of vertical tabs useful when installing.

As best understood from FIG. 11, the main portion 52 is substantially parallel to the horizontal plane P. The main portion 52 is disposed upwardly from a bottom of the shell 10 between 20% and 40% of an overall height of the shell 10. In the illustrated embodiment, the main portion 52 of the intermediate baffle 50 is disposed upwardly from a bottom of the shell 10 about 30% of an overall height of the shell 10. However, the main portion 52 is preferably located above the pass lane PL. Therefore, the dimensions locations of 20% and 40% may not be to scale in FIG. 11 (mainly the location of 20%). In addition, the intermediate baffle 50 has a lateral width not more than 20% of an overall width of the shell 10 measured at the intermediate baffle 50.

The function(s) of the intermediate baffles 50 will now be explained in more detail. As mentioned above, the main portion 52 has the holes 58. Alternatively, the main portion 52 can be a grated or louvered area. In any case, the main portion 58 evens out any high velocity spots and catches droplets and drains them back to liquid pool. Thus, the intermediate baffles 50 are used to reduce local vapor velocity between the first and second tube passes and remove any liquid droplets by momentum. The liquid droplets are stopped (physically) from rising by collision with grid, perforated plate, louvers or the like formed in the main portion 52. While the intermediate baffle 50 can provide some benefit by itself, the intermediate baffle is particularly useful when used in combination with the upper baffle 40. This is because the presence of the upper baffle 40 can lead to high velocity vapor flow and droplets being entrained in such vapor flow. A total opening area of the main portion 52 is preferably between 35%-65% of an overall area. In the illustrated embodiment, the total opening area is about 50%. In addition, the individual opening size with the openings 58 being used is preferably 2-10 millimeters in diameter. The hole size is of the holes 58 are smaller than the hole size of the openings 48 of the upper baffle. In addition, a total area of the holes 58 is preferably a smaller percentage than the total area of the upper baffle 40.

As is understood from the above descriptions, the intermediate baffles 50 are vertically disposed below the upper baffles 40, with the intermediate baffles 50 extending laterally inwardly from the lateral sides LS of the shell. Thus, the intermediate baffles 50 can also be considered lower baffles 50 because they are below the upper baffles 40. Although the intermediate (lower) baffles 50 are below the upper baffles, the intermediate (lower) baffles 50 are preferably vertically disposed above the pass lane PL. In addition, the intermediate (lower) baffles 50 are preferably vertically disposed 20% to 40% of an overall height of the shell 10 above a bottom edge of the shell 10, as best understood from FIG. 11. In addition, the intermediate (lower) baffles 50 extend laterally inwardly from the lateral sides LS of the shell by distances not more than 20% of a width of the shell 10 measured at the intermediate (lower) baffles 50 and perpendicularly relative to the longitudinal center axis C. Since, the intermediate baffles 50 can also be considered lower baffles 50, the intermediate (lower) baffles 50 preferably include lower permeable portions 52. In addition, the intermediate (lower) baffles 50 are formed of a non-permeable material with holes 58 formed therein to form the lower permeable portions 52. As can be seen in FIG. 7, each lower permeable portion 52 forms a majority of each intermediate (lower) baffle 50. In addition, the intermediate (lower) baffles 50 extend laterally inwardly toward the tube bundle 30 to free ends of the intermediate (lower) baffles 50 that are laterally spaced from the tube bundle 30.

As mentioned above, in the illustrated embodiment, a pair of intermediate (lower) baffles 50 are preferably present that are mirror images of each other. However, one intermediate (lower) baffle 50 can provide benefits, and thus, the heat exchanger 1 preferably includes at least one intermediate (lower) baffle 50, and does not necessarily require both.

Referring now to FIGS. 4-7 and 12, the lower baffles 60 will now be explained in more detail. As mentioned above, in the illustrated embodiment, the heat exchanger 1 includes a pair of lower baffles 60, with one of the lower baffles 60 disposed on each lateral side of the refrigerant distributor 20 and the tube bundle 30. The lower baffles 60 are identical to each other. However, the lower baffles 60 are mounted to face each other in a mirror image arrangement relative to the vertical plane V passing through the central axis C, as best understood from FIGS. 5-6. Therefore, only one of the lower baffles 60 will be discussed and/or illustrated in detail herein. However, it will be apparent to those having ordinary skill in the art that the descriptions and illustrations of one of the lower baffles 60 also applies to the other lower baffle 60. In addition, it will be apparent that either of the lower baffles 60 could be referred to as a first lower baffle 60 and either of the lower baffles 60 could be referred to a second lower baffle 60, and vice versa. The lower baffles 60 are disposed below the upper baffles 40 and the intermediate baffles 50. Thus, the intermediate baffles 50 could also be considered upper baffles as compared to the lower baffles 60.

The lower baffle 60 includes a main portion 62 and an inner flange portion 64 extending downwardly from the inner edge of the main portion 62. In the illustrated embodiment, the main portion 62 and the inner flange portion 64 are each formed of a rigid sheet/plate material such as metal, which prevents liquid and gas refrigerant from passing therethrough unless holes are formed therein (none used in the illustrated embodiment). In addition, in the illustrated embodiment, the main portion 62 and the inner flange portion 64 are integrally formed together as a one-piece unitary member. However, it will be apparent to those skilled in the art from this disclosure that these plates 62 and 64 may be constructed as separate members, which are attached to each other using any conventional technique such as welding. In either case, the main portion 62 is preferably a non-permeable portion that prevents liquid and gas refrigerant from passing therethrough. The inner flange portion 64 can be permeable or non-permeable. However, in the illustrated embodiment, the inner flange portion 64 is non-permeable for a more rigid outer portion than if constructed of permeable material.

Referring still to FIGS. 4-7 and 12, the main portion 62 is a planar portion that extends substantially parallel to the horizontal plane P. On the other hand, the flange portion 64 extends substantially vertically. In addition, the main portion 62 and the inner flange portion 64 are supported by the grooves 36 of the tube support plates 32 (shown in FIG. 13). Specifically, the grooves 36 are sized and shaped to receive the lower baffle 60 therein in a longitudinally slidable manner. The main portion 62 is disposed upwardly from a bottom of the shell 10 between 5% and 40% of an overall height of the shell 10. In the illustrated embodiment, the main portion 62 of the lower baffle 60 is disposed upwardly from a bottom of the shell 10 about 15% of an overall height of the shell 10. However, the main portion 62 is preferably located below the pass lane PL. Therefore, the dimensions locations of 5% and 40% may not be to scale in FIG. 12 (mainly the location of 40%). In addition, the lower baffle 60 has a lateral width not more than 20% of an overall width of the shell 10 measured at the lower baffle 60. The vertical positions and lateral widths are best understood from FIG. 12.

The function(s) of the lower baffles 60 will now be explained in more detail. The lower baffles 60 are used to deflect toward dry tubes any liquid stream coming from the flooded region on the shell side. Thus, the lower baffles are obstacles for liquid refrigerant to climb up the side of shell. Pooled liquid refrigerant in the flooded region tends to bubble and rise up the side of shell 10. However, the lower baffles 60 are used to trap any liquid refrigerant being dragged up the sides of the shell 10 and direct it onto the refrigerant tubes 31 for evaporation. In the lower group LG of refrigerant tubes 31 some of the tubes 31 are disposed under the lower baffles 60 and adjacent to the lower baffles 60 at locations below the flange portion 64. These tubes 31 perform a function of mist eliminator tubes.

As is understood from the above descriptions, the lower baffles 60 extend from the lateral sides LS of the shell 10, with the lower baffles being vertically disposed 5% to 40% of an overall height of the shell 10 above a bottom edge of the shell 10, and the lower baffles 60 extend laterally inwardly from the lateral sides LS of the shell 10 by a distance not more than 20% of a width of the shell measured at the lower baffles and perpendicularly relative to the longitudinal center axis C. In addition, the lower baffles 60 preferably include lateral (main) portions 62 substantially parallel to the horizontal plane P, and hook (flange) portions 64 extending downwardly from the lateral portions 62 at locations laterally spaced from the lateral sides LS of the shell 10. As seen in FIGS. 6-7, the hook (flange) portions 64 are preferably laterally disposed at ends of the lateral (main) portions 62 furthest from the lateral sides LS of the shell 10, and are substantially perpendicular to the horizontal plane P.

As mentioned above, the lower baffles 60 are each preferably constructed of non-permeable material such as sheet metal. In addition, the lower baffles 60 are preferably vertically disposed below the pass lane PL and above the liquid level LL of the liquid refrigerant. In the illustrated embodiment, the lower baffles 60 are preferably vertically disposed closer to the pass lane PL than to the liquid level LL. In addition, the lower group LG of heat transfer tubes 31 preferably has a lateral width larger than a lateral width of the upper group UG of heat transfer tubes 31. Such an arrangement can aid in mist elimination near the lower baffles 60. Moreover, at least one of the heat transfer tubes 31 is preferably vertically disposed below each of the lower baffles 60 and laterally outwardly of ends of the lower baffles 60 furthest from the lateral sides LS of the shell 10 so that each of the lower baffles 60 vertically overlaps the at least one heat transfer tube as viewed vertically. In addition, at least one of the heat transfer tubes 31 is laterally disposed within one tube diameter of each of the lower baffles as measured perpendicularly relative to the longitudinal center axis C.

As mentioned above, in the illustrated embodiment, a pair of lower baffles 60 are preferably present that are mirror images of each other. However, one lower baffle 60 can provide benefits, and thus, the heat exchanger 1 preferably includes at least one lower baffle 60, and does not necessarily require both.

Referring now to FIGS. 4-8 and 10, the upright baffles 70 will now be explained in more detail. As mentioned above, in the illustrated embodiment, the heat exchanger 1 includes a pair of upright baffles 70, with one of the upright baffles 70 disposed on each lateral side of the refrigerant distributor 20 and the tube bundle 30. The upright baffles 70 are identical to each other. However, the upright baffles 70 are mounted to face each other in a mirror image arrangement relative to the vertical plane V passing through the central axis C, as best understood from FIGS. 5-6. Therefore, only one of the upright baffles 70 will be discussed and/or illustrated in detail herein. However, it will be apparent to those having ordinary skill in the art that the descriptions and illustrations of one of the upright baffles 70 also applies to the other upright baffle 70. In addition, it will be apparent that either of the upright baffles 70 could be referred to as a first upright baffle 70 and either of the upright baffles 70 could be referred to a second upright baffle 70, and vice versa.

The upright baffle 70 includes an upper portion 72 and a baffle portion 74 extending downwardly from the outer edge of the upper portion 72. In the illustrated embodiment, the upper portion 72 and the baffle portion 74 are each formed of a rigid sheet/plate material such as metal, which prevents liquid and gas refrigerant from passing therethrough unless holes are formed therein (none used in the illustrated embodiment). In addition, in the illustrated embodiment, the upper portion 72 and the baffle portion 74 are integrally formed together as a one-piece unitary member. However, it will be apparent to those skilled in the art from this disclosure that these plates 72 and 74 may be constructed as separate members, which are attached to each other using any conventional technique such as welding. In either case, the upper portion 72 can be permeable or non-permeable. However, in the illustrated embodiment, the upper portion 72 is non-permeable for a more rigid outer portion than if constructed of permeable material. However, the baffle portion 74 is preferably a non-permeable portion that prevents liquid and gas refrigerant from passing therethrough.

Referring still to FIGS. 4-8 and 10, the upper portion 72 is a planar portion that extends substantially parallel to the horizontal plane P. On the other hand, the baffle portion 74 is a planar portion that extends substantially vertically perpendicular to the horizontal plane P. In addition, the upper portion 72 and the baffle portion 74 are supported by the grooves 37 of the tube support plates 32. Specifically, the grooves 37 are sized and shaped to receive the upright baffle 70 therein in a longitudinally slidable manner or from vertically above. The grooves 37 are deeper than the upper portion 72 so the inner part of the upper baffles 40 can be mounted on top of the upper portions 72 yet still be flush with a central section 38 of the upper surface of the tube support plate 32 as shown in FIG. 13.

The function(s) of the upright baffles 70 will now be explained in more detail. The upright baffles 70 are used to isolate any liquid leakage from the refrigerant distributor 20 from the bulk vapor flow. Also, the upright baffles are used to trap and drain any liquid refrigerant from high speed vapor refrigerant between the top row of the falling film bank (top of tube bundle 30) and the bottom of the refrigerant distributor 20. Some liquid refrigerant may hang on the bottom of refrigerant distributor 20 and can be drawn out to a side supported by vertical tube support plates 32. However, the upright baffles can assist in preventing (or reducing) such flow from flowing outwardly of the tube bundle 30, e.g., can guide liquid to flow over tube bundle 30. The upright baffles 70 could be mounted to the bottom of refrigerant distributor 20 or to upper baffles 30 if present. Alternatively, the upright baffles 70 could be mounted to the tube support plates 32.

As is understood from the above descriptions, the upright baffles 70 extend downwardly from the refrigerant distributor 20 at a top of the tube bundle 30 to at least partially vertically overlap the top of the tube bundle 30, with the upright baffles being disposed laterally outwardly of the tube bundle 30 toward the lateral sides LS of the shell 10. Preferably, the upright baffles 70 are disposed laterally outwardly of the tube bundle 30 toward the lateral sides LS of the shell 10 by a distance not larger than three times a tube diameter of the heat transfer tubes 31, as best understood from FIG. 10. More preferably, the upright baffles 70 are disposed laterally outwardly of the tube bundle 30 toward the lateral sides LS of the shell 10 by a distance not larger than two times a tube diameter of the heat transfer tubes 31. In the illustrated embodiment, the upright baffles 70 are disposed laterally outwardly of the tube bundle 30 toward the lateral sides LS of the shell 10 by a distance about one times the tube diameter of the heat transfer tubes or less. Preferably, the upright baffles 70 are disposed laterally outwardly of the tube bundle 30 toward the lateral sides LS of the shell 10 by a distance about one times a tube diameter of the heat transfer tubes 31 or less.

Figure 10:
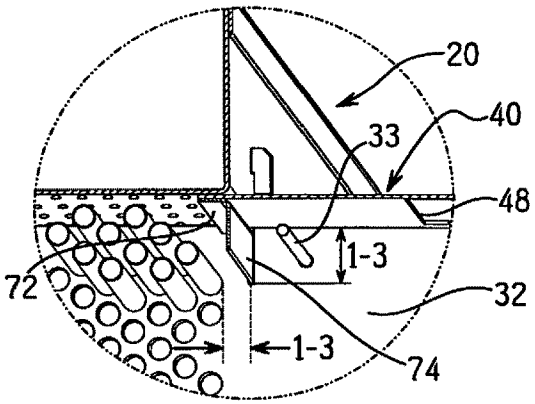
FIG. 10 is a partial view of the circled section A in FIG. 8, but with vertical and lateral dimensions of the vertical baffle relative to tube diameter indicated thereon.

In addition, the upright baffles 70 preferably vertically overlap the top of the tube bundle 30 by a distance of one to three times the tube diameter, as best understood from FIG. 10. As mentioned above, each upright baffle 70 preferably includes a baffle portion 74 extending substantially perpendicular to the horizontal plane P. The upright baffles are vertically supported by at least one tube support 32 that supports the tube bundle 30. The at least one tube support 32 has a slot that receives and supports the baffle portion 74. Each upright baffle also preferably includes a lateral portion (upper portion) 72 extending from the baffle portion 74 in a direction substantially parallel to the horizontal plane P, and the lateral portion 72 is vertically supported by the at least one tube support 32. The lateral (upper) portion 72 is preferably vertically sandwiched between the at least one tube support 32 and a bottom of the refrigerant distributor 20. The lateral (upper) portions 72 extend laterally inwardly from upper ends of the baffle portions 74 in directions away from the lateral sides LS of the shell 10. The upright baffles 70 can be fixedly attached to other parts of the heat exchanger 1. For example, the upright baffles 70 can be tack welded to be maintained in position. In the illustrated embodiment, the upright baffles 70 are preferably constructed of non-permeable material such as sheet metal.

As mentioned above, in the illustrated embodiment, a pair of upright baffles 70 are preferably present that are mirror images of each other. However, one upright baffle 70 can provide benefits, and thus, the heat exchanger 1 preferably includes at least one upright baffle 70, and does not necessarily require both.

Referring now to FIG. 13, one of the tube support plates 32 is illustrated in order clearly illustrate the pair of laterally spaced upper surfaces 34, the pair of laterally spaced intermediate slots 35, the pair of laterally spaced lower slots 36, the pair of upper slots 37, the central section 38 of the upper surface, and the support flanges 39. The surface 38 is disposed between the slots 37. These features were discussed above, and thus, will not be discussed in further detail herein. However, it is noted that in the illustrated embodiment, each of the support plates 32 is preferably cut from a thin sheet material such as sheet metal into the desired shape illustrated in FIG. 13. The upper baffles 40 are mounted by either moving the upper baffles 40 vertically downward onto the tube support plates 32 or from the lateral sides of the tube support plates 32. The upright baffles 70 should be inserted vertically downward before the upper baffles 40. The intermediate baffles 50 are inserted from the lateral sides of the tube support plates 32. The lower baffles 60 are inserted longitudinally into the tube support plates 32. Preferably, all of the baffles 40, 50, 60 and 70 are installed before installing the tube bundle in the shell 10.

Each pair of baffles 40, 50, 60 and 70 has benefits alone, and each individual baffle has benefits alone. However, the baffles 40, 50, 60, and 70 can be used in any combination.

For example, one or both upper baffles 40 can be used without any other baffles 50, 60 or 70. Likewise, one or both lower baffles 60 can be used without any other baffles 40, 50 or 70. Likewise, one or both upright baffles 70 can be used without any other baffles 40, 50 or 60. While one or both intermediate baffles 50 can be used without any other baffles 40, 60 or 70, the intermediate baffles 50 are more beneficial when used with the upper baffles 40. The upper baffles 40, the lower baffles 60 and the upright baffles 70 are beneficial alone and when used with any of the other baffles. The baffles 40, 50, 60 and 70 may merely rest within the shell 10, or maybe be tack welded at one or more locations. For example, tack welds at opposite ends of each baffle 40, 50, 60 and 70 can be used to secure the baffles 40, 50, 60 and 70.

Modified Tube Arrangement

Figure 14:
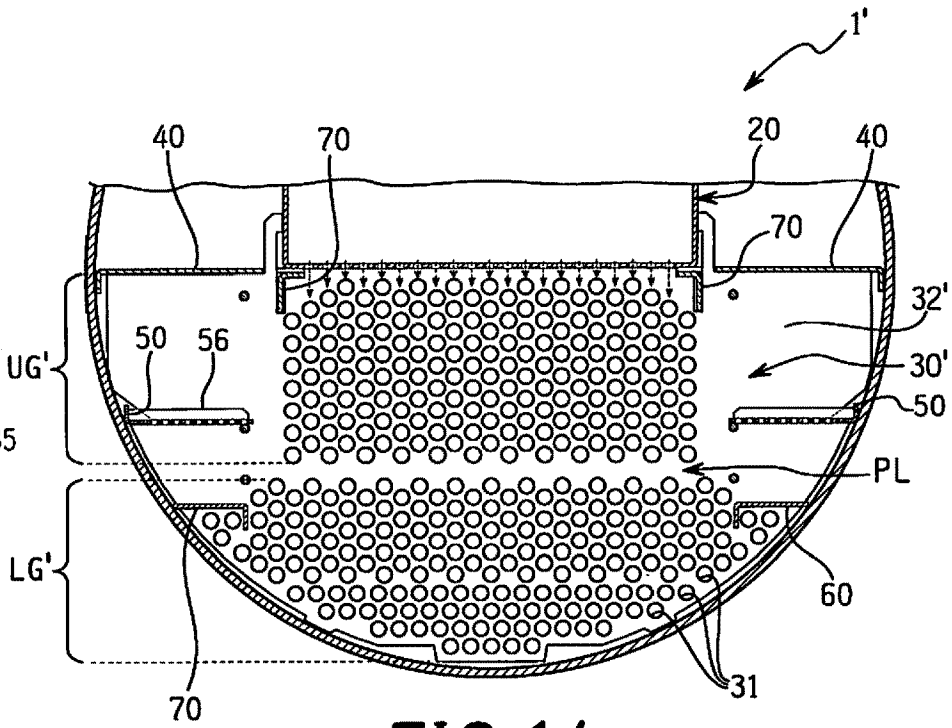
FIG. 14 is an enlarged partial transverse cross-sectional view of the structure illustrated in FIG. 5 but with additional optional heat transfer tubes illustrated thereon in accordance with a modified embodiment.

Referring now to FIG. 14, part of a modified evaporator 1' is illustrated with a modified tube bundle 31' in accordance with a modified embodiment. This modified embodiment is identical to the preceding embodiment, except for the modified tube bundle 31'. Therefore, it will be apparent to those of ordinary skill in the art from this disclosure that the descriptions and illustrations of the preceding embodiment also apply to this modified embodiment, except as explained and illustrated herein. In the modified tube bundle 30' additional outer rows of tubes 31 are provided to form a modified upper group UG and a modified lower group LG. In the upper group UG, the additional rows are positioned so refrigerant directed from the upright baffles 70 falls thereon. In the lower group LG, only two additional tubes 31 are provided adjacent the lower baffles 60 to further aid in mist elimination. Due to the above arrangements, the upright baffles 70 are disposed laterally outwardly of the tube bundle 30 toward the lateral sides LS of the shell 10 by a distance less than one times a tube diameter of the heat transfer tubes 31, and may be aligned with the heat transfer tubes 31 adjacent thereto. Modified tube support plates 32' are needed, which have more holes to accommodate the additional tubes 31. Otherwise, the tube support plates 32' are identical to the tube support plates 32.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiments, the following directional terms "upper", "lower", "above", "downward", "vertical", "horizontal", "below" and "transverse" as well as any other similar directional terms refer to those directions of an evaporator when a longitudinal center axis thereof is oriented substantially horizontally as shown in FIGS. 4 and 5. Accordingly, these terms, as utilized to describe the present invention should be interpreted relative to an evaporator as used in the normal operating position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A heat exchanger adapted to be used in a vapor compression system, the heat exchanger comprising:

a shell having a refrigerant inlet that at least refrigerant with liquid refrigerant flows therethrough and a shell refrigerant vapor outlet, with a longitudinal center axis of the shell extending substantially parallel to a horizontal plane;

a refrigerant distributor fluidly communicating with the refrigerant inlet and disposed within the shell, the refrigerant distributor having at least one liquid refrigerant distribution opening that distributes liquid refrigerant;

a tube bundle disposed inside of the shell below the refrigerant distributor so that the liquid refrigerant discharged from the refrigerant distributor is supplied to the tube bundle, the tube bundle including a plurality of heat transfer tubes grouped together; and a first upper baffle vertically disposed at a top of the tube bundle, the first upper baffle extending laterally outwardly from the tube bundle toward a first lateral side of the shell, the first upper baffle being attached to an inner surface of the shell.

2. The heat exchanger according to claim 1, wherein the first upper baffle includes a first upper non-permeable portion laterally disposed adjacent to the tube bundle.

3. The heat exchanger according to claim 2, wherein the first upper baffle includes a first upper permeable portion laterally disposed outwardly of the first upper non-permeable portion, and the first upper permeable portion is adjacent to the first lateral side of the shell.

4. The heat exchanger according to claim 3, wherein the first upper permeable portion has a lateral width less than 50% of an overall lateral width of the first upper baffle.

5. The heat exchanger according to claim 4, wherein the first upper non-permeable portion has a lateral width larger than the lateral width of the first upper permeable portion.

6. A heat exchanger adapted to be used in a vapor compression system, the heat exchanger comprising:

a shell having a refrigerant inlet that at least refrigerant with liquid refrigerant flows therethrough and a shell refrigerant vapor outlet, with a longitudinal center axis of the shell extending substantially parallel to a horizontal plane;

a refrigerant distributor fluidly communicating with the refrigerant inlet and disposed within the shell, the refrigerant distributor having at least one liquid refrigerant distribution opening that distributes liquid refrigerant;

a tube bundle disposed inside of the shell below the refrigerant distributor so that the liquid refrigerant discharged from the refrigerant distributor is supplied to the tube bundle, the tube bundle including a plurality of heat transfer tubes grouped together; and a first upper baffle vertically disposed at a top of the tube bundle, the first upper baffle extending laterally outwardly from the tube bundle toward a first lateral side of the shell, the first upper baffle including a first upper non-permeable portion laterally disposed adjacent to the tube bundle, and a first upper permeable portion laterally disposed outwardly of the first upper non-permeable portion, the first upper permeable portion being adjacent to the first lateral side of the shell, the first upper baffle being formed of a non-permeable material with holes formed therein to form the first upper permeable portion.

7. The heat exchanger according to claim 1, wherein the first upper baffle is vertically disposed at a bottom of the refrigerant distributor.

8. The heat exchanger according to claim 7, wherein the first upper baffle is attached to a bottom of the refrigerant distributor.

9. A heat exchanger adapted to be used in a vapor compression system, the heat exchanger comprising:

a shell having a refrigerant inlet that at least refrigerant with liquid refrigerant flows therethrough and a shell refrigerant vapor outlet, with a longitudinal center axis of the shell extending substantially parallel to a horizontal plane;

a refrigerant distributor fluidly communicating with the refrigerant inlet and disposed within the shell, the refrigerant distributor having at least one liquid refrigerant distribution opening that distributes liquid refrigerant;

a tube bundle disposed inside of the shell below the refrigerant distributor so that the liquid refrigerant discharged from the refrigerant distributor is supplied to the tube bundle, the tube bundle including a plurality of heat transfer tubes grouped together; and a first upper baffle vertically disposed at a top of the tube bundle, the first upper baffle extending laterally outwardly from the tube bundle toward a first lateral side of the shell, the first upper baffle being vertically disposed at a bottom of the refrigerant distributor, and the first upper baffle being vertically supported by at least one tube support that supports the tube bundle.

10. The heat exchanger according to claim 1, wherein the first upper baffle is vertically disposed 40% to 70% of an overall height of the shell above a bottom edge of the shell.

11. The heat exchanger according to claim 1, further comprising a second upper baffle vertically disposed at the top of the tube bundle, the second upper baffle extending laterally outwardly from the tube bundle toward a second lateral side of the shell.

12. A heat exchanger adapted to be used in a vapor compression system, the heat exchanger comprising:

a shell having a refrigerant inlet that at least refrigerant with liquid refrigerant flows therethrough and a shell refrigerant vapor outlet, with a longitudinal center axis of the shell extending substantially parallel to a horizontal plane;

a refrigerant distributor fluidly communicating with the refrigerant inlet and disposed within the shell, the refrigerant distributor having at least one liquid refrigerant distribution opening that distributes liquid refrigerant;

a tube bundle disposed inside of the shell below the refrigerant distributor so that the liquid refrigerant discharged from the refrigerant distributor is supplied to the tube bundle, the tube bundle including a plurality of heat transfer tubes grouped together;

a first upper baffle vertically disposed at a top of the tube bundle, the first upper baffle extending laterally outwardly from the tube bundle toward a first lateral side of the shell; and a first lower baffle vertically disposed below the first upper baffle, the first lower baffle extending laterally inwardly from the first lateral side of the shell.

13. The heat exchanger according to claim 12, wherein the plurality of heat transfer tubes are grouped to form an upper group and a lower group with a pass lane disposed between the upper group and the lower group, and the first lower baffle is vertically disposed above the pass lane.

14. The heat exchanger according to claim 12, wherein the first lower baffle is vertically disposed 20% to 40% of an overall height of the shell above a bottom edge of the shell.

15. The heat exchanger according to claim 12, wherein the first lower baffle extends laterally inwardly from the first lateral side of the shell by a distance not more than 20% of a width of the shell measured at the first lower baffle and perpendicularly relative to the longitudinal center axis.

16. The heat exchanger according to claim 12, wherein the first lower baffle includes a first lower permeable portion.

17. The heat exchanger according to claim 16, wherein the first lower baffle is formed of a non-permeable material with holes formed therein to form the first lower permeable portion.

18. The heat exchanger according to claim 16, wherein the first lower permeable portion forms a majority of the first lower baffle.

19. The heat exchanger according to claim 12, wherein the first lower baffle extends laterally inwardly toward the tube bundle to a free end of the first lower baffle that is laterally spaced from the tube bundle.

20. The heat exchanger according to claim 12, further comprising a second upper baffle vertically disposed at the top of the tube bundle, the second upper baffle extending laterally outwardly from the tube bundle toward a second lateral side of the shell; and a second lower baffle vertically disposed below the second upper baffle, the second lower baffle extending laterally inwardly from the second lateral side of the shell.

* * * * *